US009414699B2

(12) United States Patent
Wing et al.

(10) Patent No.: US 9,414,699 B2
(45) Date of Patent: Aug. 16, 2016

(54) BEVERAGE CONTAINER WITH REMOVABLE TOP

(76) Inventors: Dominic John Wing, Brisbane (AU); Calile Damien Malouf, Brisbane (AU); Michael Calile Malouf, Toowong (AU); Scot Farley, Brisbane (AU)

( * ) Notice: Subject to any disclaimer, the term of this patent is extended or adjusted under 35 U.S.C. 154(b) by 0 days.

(21) Appl. No.: 11/659,410

(22) PCT Filed: Sep. 6, 2005

(86) PCT No.: PCT/AU2005/001350

§ 371 (c)(1),
(2), (4) Date: Dec. 8, 2008

(87) PCT Pub. No.: WO2006/029441

PCT Pub. Date: Mar. 23, 2006

(65) Prior Publication Data

US 2010/0294770 A1 Nov. 25, 2010

(30) Foreign Application Priority Data

| | | |
|---|---|---|
| Sep. 13, 2004 | (AU) | 2004905218 |
| Dec. 2, 2004 | (AU) | 2004906885 |
| Dec. 2, 2004 | (AU) | 2004906886 |
| Feb. 2, 2005 | (AU) | 2005900448 |
| Mar. 31, 2005 | (AU) | 2005901560 |
| Jul. 7, 2005 | (AU) | 2005903600 |

(51) Int. Cl.

| | |
|---|---|
| ***B65D 17/34*** | (2006.01) |
| ***A47G 19/22*** | (2006.01) |
| ***B65D 17/00*** | (2006.01) |
| ***B65D 41/17*** | (2006.01) |

(Continued)

(52) U.S. Cl.

CPC ..... *A47G 19/2205* (2013.01); *B65D 17/163* (2013.01); *B65D 17/165* (2013.01); *B65D 17/20* (2013.01); *B65D 41/17* (2013.01); *B65D 43/0218* (2013.01); *B65D 43/0229* (2013.01); *B65D 43/0231* (2013.01); *B65D 45/34* (2013.01); *B65D 51/20* (2013.01); *B65D 81/2015* (2013.01); *B65D 2251/0031* (2013.01); *B65D 2251/0071* (2013.01); *B65D 2517/0013* (2013.01); *B65D 2517/0098* (2013.01); *B65D 2543/00935* (2013.01)

(58) Field of Classification Search

CPC ..... B65D 17/165; B65D 17/20; B65D 41/17; A47G 19/2205

USPC ..... 220/270, 260, 265, 266, 267, 272, 273, 220/276, 277, 285, 309.1

See application file for complete search history.

(56) References Cited

U.S. PATENT DOCUMENTS

| | | | |
|---|---|---|---|
| 1,908,037 | A | 5/1933 | MacCordy |
| 2,005,784 | A | 6/1935 | Harvey |

(Continued)

FOREIGN PATENT DOCUMENTS

| | | |
|---|---|---|
| CN | 88 2 03356 | 2/1988 |
| CN | 2050830 U | 9/1989 |

(Continued)

*Primary Examiner* — Steven A. Reynolds
(74) *Attorney, Agent, or Firm* — Stein IP, LLC

(57) ABSTRACT

A beverage container containing a removable lid, the container including a rim, a side wall depending from the rim, a shoulder portion extending inwardly from the side wall, the removable lid comprising an edge extending over the rim, and along the side wall, and against the shoulder portion thereby attaching the lid to the container.

20 Claims, 42 Drawing Sheets

(51) Int. Cl.

| | |
|---|---|
| ***B65D 43/02*** | (2006.01) |
| ***B65D 45/34*** | (2006.01) |
| ***B65D 51/20*** | (2006.01) |
| ***B65D 81/20*** | (2006.01) |

(56) References Cited

U.S. PATENT DOCUMENTS

| | | | | | |
|---|---|---|---|---|---|
| 2,108,114 | A | | 2/1938 | Foard | |
| 2,501,849 | A | | 3/1950 | Krebs | |
| 3,190,481 | A | | 6/1965 | McKnight, Jr. | 215/39 |
| 3,303,962 | A | * | 2/1967 | Lake | 220/273 |
| 3,371,811 | A | | 3/1968 | McKnight | |
| 3,371,812 | A | | 3/1968 | Foster | |
| 3,407,957 | A | * | 10/1968 | Robinson | 215/251 |
| 3,415,412 | A | * | 12/1968 | Robinson et al. | 220/270 |
| 3,465,910 | A | * | 9/1969 | Richie | 220/270 |
| 3,625,392 | A | * | 12/1971 | Kaminski | 220/270 |
| 3,905,503 | A | * | 9/1975 | Fraze | 215/255 |
| 4,503,990 | A | * | 3/1985 | Roth et al. | 220/276 |
| 4,572,393 | A | * | 2/1986 | Kobayashi et al. | 220/270 |
| 4,640,435 | A | | 2/1987 | Dutt | |
| 5,460,287 | A | * | 10/1995 | Cargile et al. | 220/276 |
| 5,477,979 | A | | 12/1995 | Goessling et al. | |
| 5,806,700 | A | | 9/1998 | Henning | 215/328 |
| 6,196,408 | B1 | * | 3/2001 | Setty et al. | 220/276 |
| 6,290,084 | B1 | * | 9/2001 | Louie | 220/254.4 |
| 6,588,614 | B2 | * | 7/2003 | Neuner | 215/40 |

FOREIGN PATENT DOCUMENTS

| | | | |
|---|---|---|---|
| DE | 92 12 644 | | 12/1992 |
| DE | 20205239 | U | 6/2002 |
| DE | 101 42 532 | | 3/2003 |
| EP | 0 517 676 | | 12/1992 |
| EP | 1 313 650 | | 10/2004 |
| FR | 2548004 | A | 1/1985 |
| FR | 2 584 680 | | 1/1987 |
| FR | 2767795 | A | 3/1999 |
| GB | 2289252 | A | 11/1995 |
| JP | 48-26153 | | 7/1973 |
| JP | 51-4750 | | 6/1976 |
| JP | 54-21054 | | 7/1979 |
| JP | 59-13468 | | 1/1984 |
| JP | 63-21247 | | 2/1988 |
| JP | S63-144425 | | 9/1988 |
| JP | 5-44848 | | 6/1993 |
| JP | 5-506416 | | 9/1993 |
| JP | 5-47086 | | 12/1993 |
| JP | 7-115945 | | 5/1995 |
| JP | 9-278046 | | 10/1997 |
| JP | 11-292111 | | 10/1999 |
| JP | 11-321907 | | 11/1999 |
| JP | 2000-053158 | | 2/2000 |
| JP | 2000-109104 | | 4/2000 |
| JP | 2002-326646 | | 11/2002 |
| JP | 2004-035011 | | 2/2004 |
| WO | WO 90/03928 | | 4/1990 |
| WO | WO 02/12085 | | 2/2002 |
| WO | WO 2004/052738 | | 6/2004 |

* cited by examiner

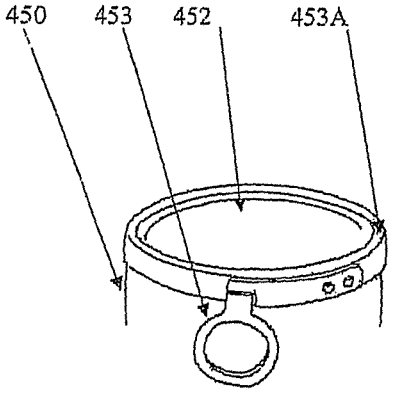
FIG 10
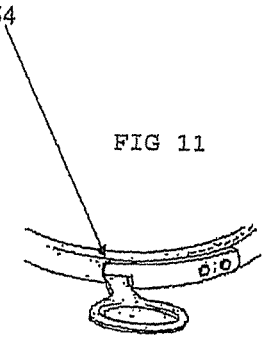
FIG 11
FIG 12
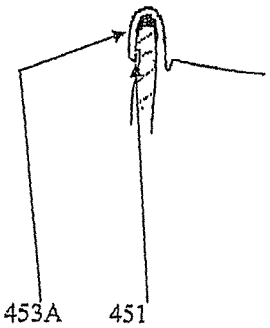
FIG 13
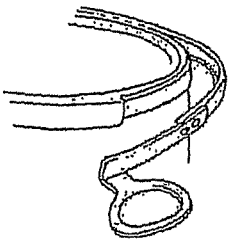
FIG 14
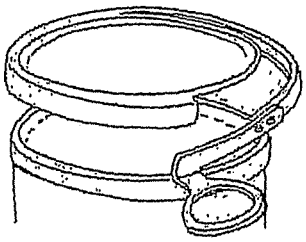

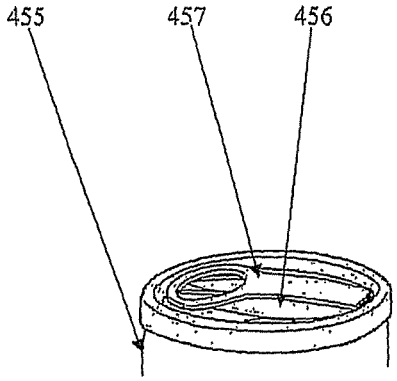
Fig 23
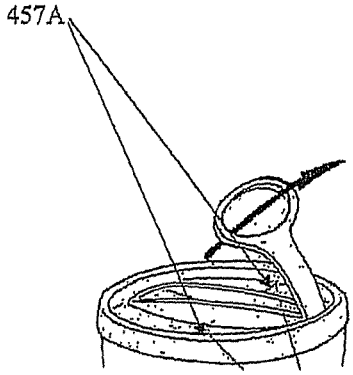
Fig 24
Fig 25
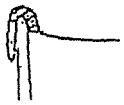
Fig 26
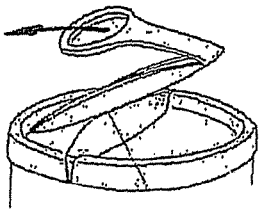
FIGS 23-26

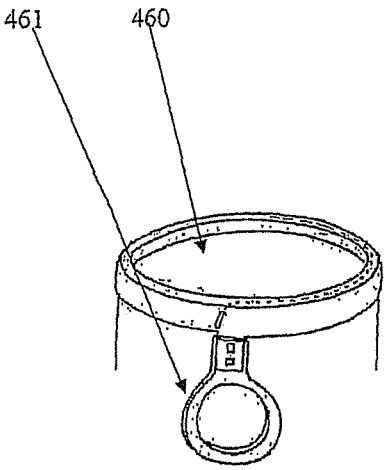
FIG 49
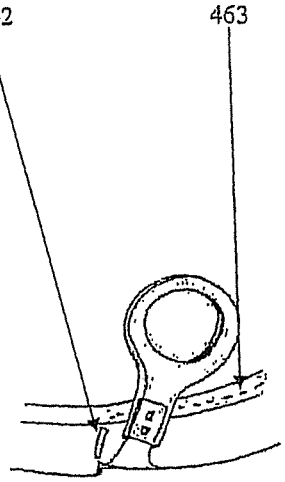
FIG 50
FIG 51
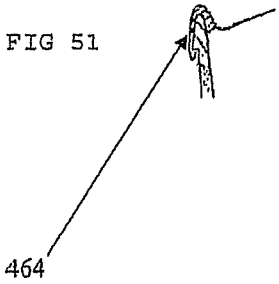
FIG 52
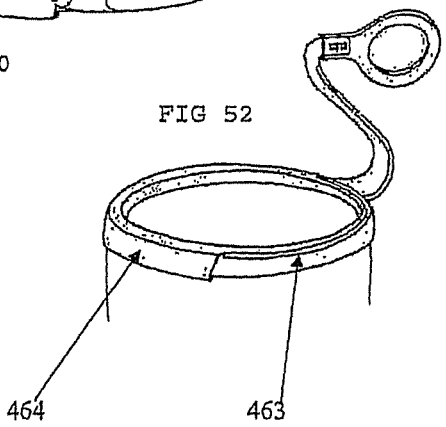
FIGS 49-52

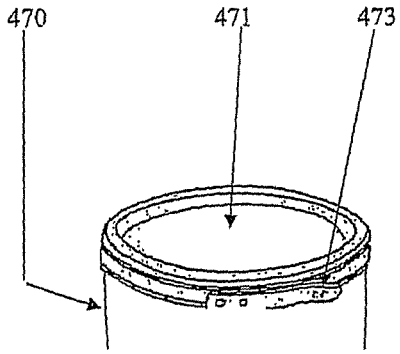
FIG 64
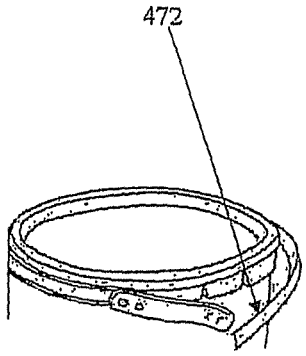
FIG 65
FIG 66
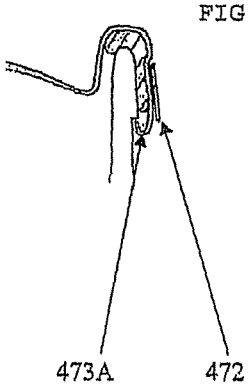
FIG 67
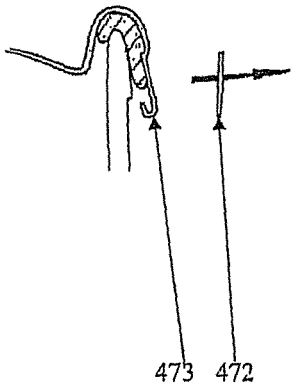
FIGS 64-67

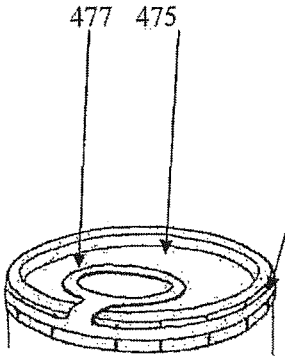
FIG 68
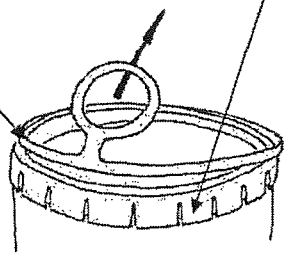
FIG 69
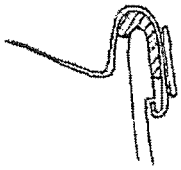
FIG 70
FIG 71
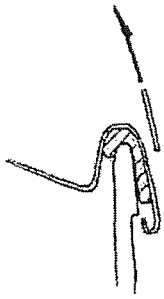
FIGS 68-71

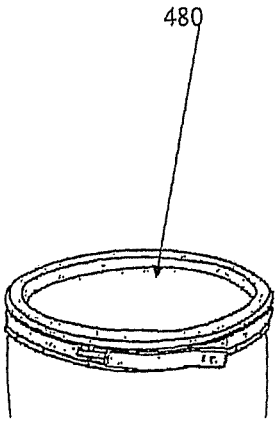
FIG 72
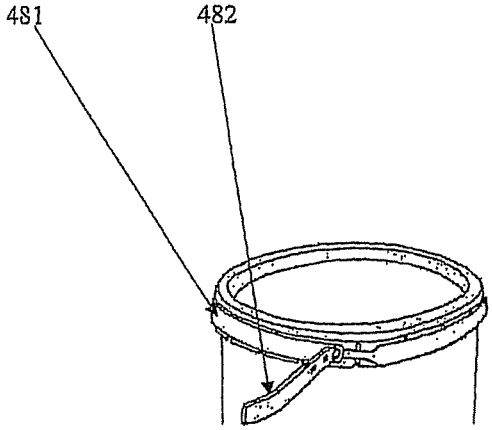
FIG 73
FIG 74
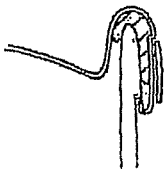
FIG 75
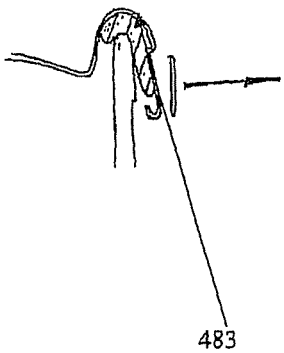
FIGS 72-75

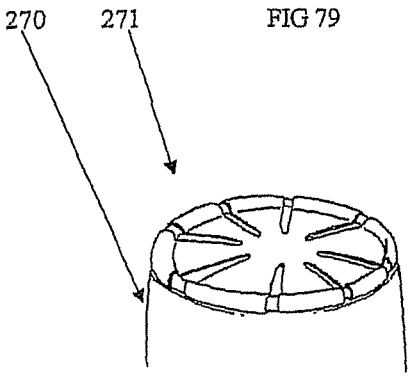
FIG 79
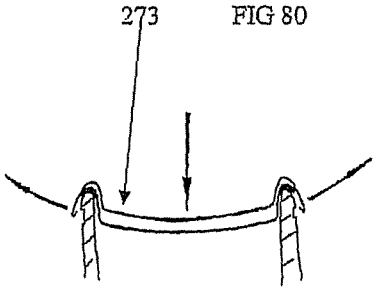
FIG 80
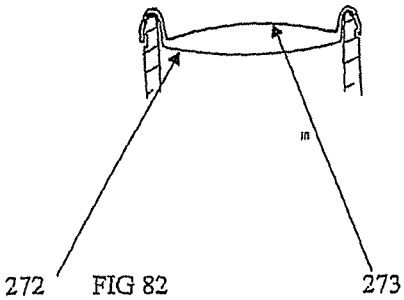
FIG 82
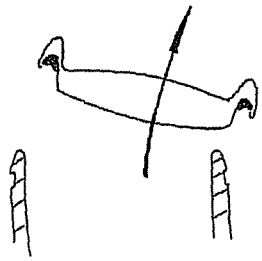
FIG 81
FIGS 79-82

BEVERAGE CONTAINER WITH REMOVABLE TOP

FIELD OF THE INVENTION

The present invention is directed to a beverage container, such as a drinking glass, which contains a seal/lid that can be removed prior to consumption of the beverage. The seal/lid and/or the beverage container can be of a special design to provide greater sealing efficiency and optionally to enable the container to contain carbonated or pressurised beverages. The invention will be described with reference to a beverage glass (which can comprise plastic as well as glass) containing an alcoholic beverage, although it should be appreciated that no particular limitation is meant to be placed on the invention merely by this reference.

BACKGROUND ART

Beverages are usually sold to consumers in containers such as glass or plastic bottles; aluminium or steel cans; cardboard or plastic cartons; or casks which include a bladder housed in a cardboard box.

Consumers currently have the choice of either drinking directly from the containers mentioned above, or transferring the liquid contained therein to a drinking glass for consumption therefrom. Many consumers prefer to drink certain types of beverages from a drinking glass with a wide mouth to enhance the aroma and therefore the flavour of the beverage.

Apart from drinking glasses, most drink containers have no worth once their contents are consumed other than perhaps as part of a recycling program. Consequently, most drink containers are simply discarded and are never recycled. Therefore, there is often a lot of domestic and industrial waste associated with the use of drink containers other than drinking glasses.

A problem with the use of drinking glasses however, particularly in the hospitality industry, is that viral and bacterial illnesses (such as hepatitis B and C, and influenza, amongst others) can be spread by the continual and frequent reuse of glasses despite the fact that the glasses are required by health codes to be washed at sterilising temperatures (typically over 80 degrees centigrade) prior to being reused.

Moreover, the provision of drinking glasses in the hospitality industry is a significant expense to many businesses in the industry for a number of reasons. Firstly, particularly in climates where beer and other drinks need to be served ice cold and where drinking glasses are therefore chilled before use, there can be significant refrigeration costs associated with chilling drinking glasses. This is because a significant amount of refrigerator space often needs to be dedicated to not only the containers in which the beverages are stored, but also to the empty drinking glasses. Also, in cases where above-bench glass chillers which chill drinking glasses by passing chilled water through the glass are used, significant costs are incurred in the purchase, installation, running costs, and maintenance of such glass chillers, to which beverage is to be poured prior to consumption.

Secondly, there are significant costs associated with purchasing drinking glasses at the outset and purchasing replacement glasses due to breakages and other mishaps.

Thirdly, the costs associated with cleaning used drinking glasses are a significant component of many businesses in the hospitality industry. These cleaning costs include the labour, chemical, hot water, and electrical costs which are associated with collecting, racking, washing and drying glasses.

Lastly, beverage companies who supply the hospitality industry with their beverages in bottles or other containers apart from drinking glasses, often also supply pubs, nightclubs and other venues with free branded drinking glasses for dispensing their product in. The cost to beverage companies of providing the drinking glasses is usually factored into their promotional glassware budgets and can be significant.

Another problem with the use of drinking glasses is that the beverage contained therein can be easily spiked with alcohol or another drug without the knowledge of the consumer. It would therefore be desirable to have a drinking glass which at least reduces the possibility of the beverage contained therein being spiked.

Furthermore, the surfaces of drinking glasses which are usually contacted by the mouths and lips of consumers are exposed and are therefore susceptible to being contaminated by unclean hands, for example. It would therefore be beneficial to have a drinking glass which reduces the possibility of the aforementioned drinking glass surfaces being contaminated.

Various attempts have been made to provide a beverage container (such as a drinking glass) which may overcome at least some of the above-mentioned disadvantages.

For instance, it is known to provide a drinking glass that contains a removable lid for sealing purposes and where the lid can be removed prior to consumption. However, there are difficulties with proper attachment of the lid to the glass and which have not been overcome by the known methods.

One difficulty is that some seals or removable lids merely extend over the top of the rim of the drinking glass. When the lid is removed (this being particularly the case for lids that are glued or similarly attached to the glass) an adhesive residue can remain behind which is unsuitable if the adhesive residue is on the rim of the glass. WO96/05123 describes such an arrangement.

Also, the surface area of the rim of the glass is relatively small and therefore there are difficulties in providing a proper seal especially if it is desirable to store a carbonated beverage in the glass in which case the seal needs to be pressure resistant.

For this reason, it is known to provide a lid that simply screws over the top of a drinking glass. This provides a good seal and makes the glass pressure tight. However, the arrangement does require a thread to be provided on the upper surface of the drinking glass and this increases the manufacturing cost of the glass, can be an encumbrance to drinkers (with the thread being very close to the rim of the glass), and the thread can be quite easily broken or damaged to present a sharp edge. This arrangement is described in German patent specification 202 05239.

Another attempt to overcome the attachment difficulties of the removable seal with the glass rim is to provide the rim with an outwardly extending peripheral flange. While this increases the surface area and therefore provides a better attachment of the seal with the rim, the outwardly extending flange makes drinking more difficult. Also, the flange is usually relatively thin and therefore brittle and is prone to being broken or cracked to produce sharp edges that can cause serious injury. This type of arrangement is described in international patent application WO96/05123.

Another disadvantage with attachment of lids to drinking vessels containing a beverage (such as wine), is that if the vessel is shaken or knocked during the lid fitting process, the wine can spill onto the rim of the vessel which can greatly reduce sealing efficiency of the lid to the rim. For this reason, it is also known to provide a specially designed wine glass which contains an opening in the bottom of the stem and which is filled from the bottom. In this way, the lid can be attached to the empty wine glass and the wine can then be filled through the stem. A stopper is required to ensure that the wine does not leak through the stem. This arrangement is quite complicated and would have high manufacturing costs. EP 309314 describes this arrangement.

Another attempt to provide a simple solution to the above disadvantages is to provide a lid or seal that overlies the rim of the glass and which extends partially down the side wall of the glass. An advantage of this type of seal is that there is no need to provide glue or other adhesive on the rim. Instead, the adhesive can be applied to the outer side wall of the glass and below the top rim. Also, by extending over the rim and down the side wall of the glass, the rim is protected against contamination prior to consumption of the wine (or other beverage) in the glass.

However, a disadvantage with this type of seal is that in practice, it is found that the seal can still inadvertently be removed from the glass and if the glass contains a pressurised beverage, the pressure tightness of the seal is not as good as it could be which means that the beverage in the glass can go flat prior to consumption. While a solution might be to simply make the seal extend further down the wall of the glass, it is found that there is a consumer advantage in being able to view the contents of the glass without the view being occluded by the seal. Also, the manufacturing cost increases. As well, when the seal is removed, any adhesive on the side wall of the glass can remain tacky which is undesirable to people holding the glass. Attempting to attach a seal without adhesive is problematic with this design of glass as there is no proper "purchase" or attachment position of the seal to the glass due to the relatively smooth nature of the glass. Thus, this type of seal can be quite unsuitable for use with pressurised or carbonated beverages.

Another disadvantage or problem with many of the known types of seals or lids is that it is often quite difficult to remove the lid or seal from the glass without spilling or upsetting the contents of the glass, this being mainly caused by the rather aggressive nature of the adhesive. Thus, there would be an advantage if it were possible to provide a seal or lid with some form of construction or design that would make removal of the lid simpler.

A difficulty in attempting to provide a removable seal or lid over a drinking vessel is that the mouth of the drinking vessel (e.g. wine glass) is quite large compared to the main body of the vessel. For pressurised systems, the force acting on the lid or seal can be calculated by the equation Force=Pressure× Area. Thus, for relatively narrow necked containers such as beer bottles, the force on the beer bottle cap is relatively low. However, for larger open mouthed glasses and similar vessels (for instance, to accommodate a carbonated beverage), the amount of force on the seal will be much larger.

There would be an advantage if it were possible to provide a removable seal or lid for a drinking vessel such as a glass and which could protect the rim of the glass against contamination, which could enable a pressurised beverage to be contained within the glass for longer, and which would have a reduced possibility of delaminating from the glass.

OBJECT OF THE INVENTION

It is an object of the present invention to overcome, or at least substantially ameliorate, one or more of the aforementioned deficiencies of the prior art, or to provide the consumer with a useful or commercial choice.

Other objects and advantages of the present invention will become apparent from the following description, taken in connection with the accompanying drawings, wherein, by way of illustration and example, an embodiment of the present invention is disclosed.

According to a broad aspect of the present invention there is provided a drinking glass and a lid covering an opening of the glass such that a drink contained in the glass is sealed therein by the lid, wherein the lid is adapted to be at least partially removed from the opening so as to thereby enable the drink to be consumed from the glass through the opening.

The lid preferably forms a hermetic seal with the glass to prevent the escape of gas from carbonated drinks stored in the glass while the opening of the glass is covered by the lid.

In a more particular form, the invention resides in a beverage container, the container comprising a side wall, a rim, and a shoulder portion which is positioned below the rim, and a removable lid, the lid, when in the closed position, sealing the beverage container, the lid having a peripheral edge that extends over the rim and against the shoulder portion.

In this form of the invention, the shoulder portion can provide a "purchase" or mechanical attachment of the lid to the beverage container. Thus, there may be no requirement to provide adhesive which has been a disadvantage with previous lids. Also, the lid can now be more suitable for use with carbonated or pressurised beverages.

Suitably, the shoulder portion extends between the rim and the side wall.

Suitably, the shoulder portion extends about the beverage container.

The shoulder portion may comprise an outwardly extending land portion that extends outwardly relative to the side wall which is immediately below the shoulder portion to provide a mechanical type attachment of the peripheral edge of the lid against the shoulder portion.

The land portion may have a width of between 0.5-5 millimeters depending on the size of the beverage container.

The side wall, rim and shoulder portion may be formed integrally.

A plurality of shoulder portions may be provided. These may extend below each other to provide annular bands of shoulder portions about the beverage container. If desired, between 1-10 shoulder portions may be provided and typically between 1-5. The spacing between the shoulder portions may be between 1-10 millimeters depending on the size of the beverage container, the pressure within the container, the type of lid and the like.

The shoulder portion may be angled other than substantially at right angles relative to the side wall. For instance, the shoulder portion may form an acute angle of between 30-90° relative to the side wall immediately below the shoulder portion. This can provide an "undercut" that may improve the mechanical attachment of the lid to the container.

The shoulder portion may comprise other profiles to improve the attachment of the lid to the container. These profiles may comprise recesses, projections, and the like to improve the mechanical attachment or the "keying" of the lid to the container.

For instance, the shoulder portion may comprise a substantially U-shaped channel extending about the rim area of the beverage container and into which an edge of the lid can pass. An embodiment of this is illustrated in figure is 35-38.

If desired, the lid and/or the container may be provided with means to facilitate removal, or at least partial removal of the lid from the container. The means may comprise a tab, a projection, a recess, a finger hole, or any other type of configuration or attachments that can facilitate removal, or at least partial removal of the lid typically by providing a better grip to a person wishing to remove the lid.

In one broad form, the means may comprise a pull tab. The pull tab may comprise a ring pull. The pull tab may comprise a finger grippable portion (a ring pull or any other type of finger grippable portion), attached to an elongate member (typically a strip member). The elongate member may comprise part of the lid such that pulling of the pull tab causes the elongate member to be ripped from the remainder of the lid, or lifted from the remainder of the lid to provide a weakening of the lid thereby facilitating removal of the lid.

The means may comprise a zone or portion or more than one zone or portion in the lid that can be lifted, removed, or otherwise manipulated to facilitate removal of the lid. The facilitation may comprise weakening of the lid upon manipulation (for instance weakening of the lid by removing a portion of the lid thereby enabling easier removal of the lid). These zones or portions may comprise frangible areas, or otherwise weakened areas.

Alternatively, the lid may be provided with a zone or portion that can be pushed at least partially into the container to provide an opening or area that can facilitate removal of the remainder of the lid.

The lid and/or container may be provided with tamper evident means. It is considered that any suitable type of tamper evident means will fall within the present invention. The tamper evident means may comprise projections or tabs that will be removed or damaged upon tampering of the lid.

The means to facilitate removal of the lid may comprise a part of the lid that can be removed from the remainder of the lid, this part being about the shoulder portion such that removal of this part removes or at least reduces the mechanical attachment of the lid to the vessel enabling the lid to be removed more easily.

The means to facilitate removal of the lid may comprise part of the lid that extends at least about part of the rim such that removal of this part of the lid reduces the attachment of the lid to the rim thereby facilitating removal of the lid from the vessel.

The means to facilitate removal of the lid may comprise a lever. The lever may be formed separately and attachable to the lid. Alternatively, the lever is formed integrally with the lid. Movement of the lever can lever the lid at least partially off the rim to make removal of the lid easier.

An advantage therefore of providing this means is that the lid can be attached in a more aggressive manner that can still be removed in a relatively easy manner making it suitable for covering alcoholic beverages, and particularly pressurised beverages where the more aggressive attachment of the lid to the vessel can improve the pressure holding characteristics of lid.

The drinking glass according to the present invention is able to serve as both a container for storing beverages, and as a traditional drinking glass from which the contents thereof can be consumed directly therefrom in the usual manner.

Preferably, the drinking glass is adapted to be reused.

The drinking glass may be constructed from glass, ceramic, plastic, metal, composite materials and the like. Typically, the glass will be made of a plastic and the glass will typically be manufactured using a blow or injection moulding process. PET is considered to be a suitable plastic, although it should be appreciated that no particular limitation should be placed on the invention merely by the material from which to drinking glass can be made and the method by which the drinking glass is made.

Therefore, it should be appreciated that the term "glass" when used in the present specification is not meant to be construed in a limiting manner and is merely a word used broadly to describe a drinking vessel that can be made of any suitable material.

The drinking glass may be any size or shape. For example, the drinking glass may be a beer glass or a wine glass of traditional size and shape. More particularly, the drinking glass may include a generally flat circular base, a stem extending upwardly from the base, and a container portion or bowl, which may or may not be tapered, extended upwardly from the stem.

Even more particularly, if the container is a beer glass, the beer glass may be a pilsner glass and if the container is a wine glass, the wine glass may be a flute glass. Of course, it should be appreciated that no particular limitation is to be placed on the invention merely by describing the container as a beer glass or a wine glass.

The drinking glass may contain any type of drink or beverage which may comprise a carbonated beverage, a "still" beverage, soft drinks, cordial, wine, beer, a dairy based beverage, a mixture which may comprise an alcoholic mixture or a non-alcoholic mixture, tea, coffee, juice, a suspension (typically comprising food particles in a liquid), a beverage dispersion, an emulsion, thickened beverages, and the like and it should be appreciated that no particular limitation should be placed on the invention merely by the type of drink or product that is within the container.

Indeed, it is considered that the invention may include food products that are quite viscous and that may need to be spooned, or sucked (for instance via a straw) from the container. These products may include yoghurts, creams, gels and the like.

The lid may comprise any suitable material to make the lid suitable for covering the otherwise open mouth of a beverage container. Thus, the lid may comprise a plastic material, a metal material, composite materials and the like.

The lid will typically comprise a film or sheet, and it is envisaged that the lid may comprise a laminate of different materials to provide desired characteristics. The laminate may enable the lid to have the required properties of strength, gas impermeability, and the like. The lid may comprise a first zone or area comprising one material and a second zone or area comprising a second material. The lid may comprise one zone or area comprising a rigid material, and a second zone or area comprising a flexible material.

The lid may comprise a unitary piece of preformed aluminium, although other metals or materials such as preformed/moulded plastic or resin may be used instead.

Suitably, the lid comprises two or more parts that may comprise an inner part to seal the beverage in the container, and an outer part to ensure that the lid is removably fixed to the container.

The piece of preformed aluminium or other material preferably has a substantially planar circular disc portion whose underside may be surrounded by a circular recessed portion and a sleeve portion.

The lid may be provided with a seal. The seal may be formed integrally with the lid, or may be formed separately and fitted to the lid, or may be formed separately and fitted to the container and the like.

A seal is preferably provided inside the lid for forming a seal between the lid and the drinking glass.

The seal may be made of any suitable material to provide a satisfactory sealing action. The seal may comprise a plastics material, a resilient material, a rubber, a neoprene, a settable material, and the like. In a particular embodiment, the seal comprises a thermoplastic elastomer which is co-moulded to the inside of the lid.

As mentioned above, the lid may include a removable portion which is preferably defined by a frangible line extending thereon. The removable portion may include two sub-portions. The sub-portions are preferably a circular sub portion, and an elongate sub-portion extending from the circular sub-portion. A pull-key can be fixed to the removable portion such that at least one of the sub-portions can be detached from the rest of the lid by pulling the pull-key to thereby open the drinking glass.

The pull-key is preferably constructed from a thermoplastic although it may also be constructed from other materials such as aluminium. The sleeve portion of the lid preferably covers a lip of the drinking glass when the lid covers the opening of the drinking glass. The lid preferably covers a lip of the drinking glass to thereby prevent the lip from being contaminated.

The lid and/or an upper portion of the vessel may contain a protective covering. The protective covering may comprise a plastic shrink sleeve or fuji seal.

The sleeve or seal preferably has a removable strip defined by frangible lines extending along the sleeve or seal such that the removable strip is able to be torn from the rest of the sleeve or strip to thereby enable the sleeve or seal to then be readily removed from the glass. The sleeve on slip can cover a lip of the drinking glass to thereby prevent the lip from being contaminated.

The lid may be adapted so that prior to opening, a number of glasses can be stacked. For example, during packaging, transport and when in a refrigerator or on a shelf, the unopened drinking glass can be stacked on top of another unopened drinking glass. The glasses can be packaged in multiple sets (e.g. a six pack, a carton etc) and can be packaged in such a way that they can be stacked pallet on pallet.

In another form, the invention comprises a removable lid/seal/cap that is attachable to a drinking vessel, the lid/seal/cap comprising a main body portion adapted to extend over the top of the drinking vessel, and edge portion adapted to engage with the side wall of the drinking vessel (the side wall including the rim), and opening means to enable the lid/seal/cap to be at least partially opened and therefore weakened to enable the lid/seal/cap to be removed more easily.

BRIEF DESCRIPTION OF THE DRAWINGS

In order that the invention may be more fully understood and put into practice, embodiments thereof will now be described with reference to the accompanying drawings, in which:

FIGS. 10-14 illustrate a further embodiment of the invention CONCEPT 21.

FIGS. 23-26 illustrate a further embodiment of the invention CONCEPT 22.

FIGS. 49-52 illustrate a further embodiment of the invention CONCEPT 23.

FIGS. 53-56A illustrate a further embodiment of the invention containing a lever and circlip. CONCEPT 16.

FIGS. 64-67 illustrate a further embodiment of the invention CONCEPT 24.

FIGS. 68-71 illustrate a further embodiment of the invention CONCEPT 25.

FIGS. 72-75 illustrate a further embodiment of the invention CONCEPT 26

FIGS. 79-82 illustrate a further embodiment of the invention which comprises a "pop off" lid. CONCEPT 14.

FIGS. 109-110A illustrate a further embodiment of the invention which contains a lid having a displacement bulb.

DETAILED DESCRIPTION

Figure 1:
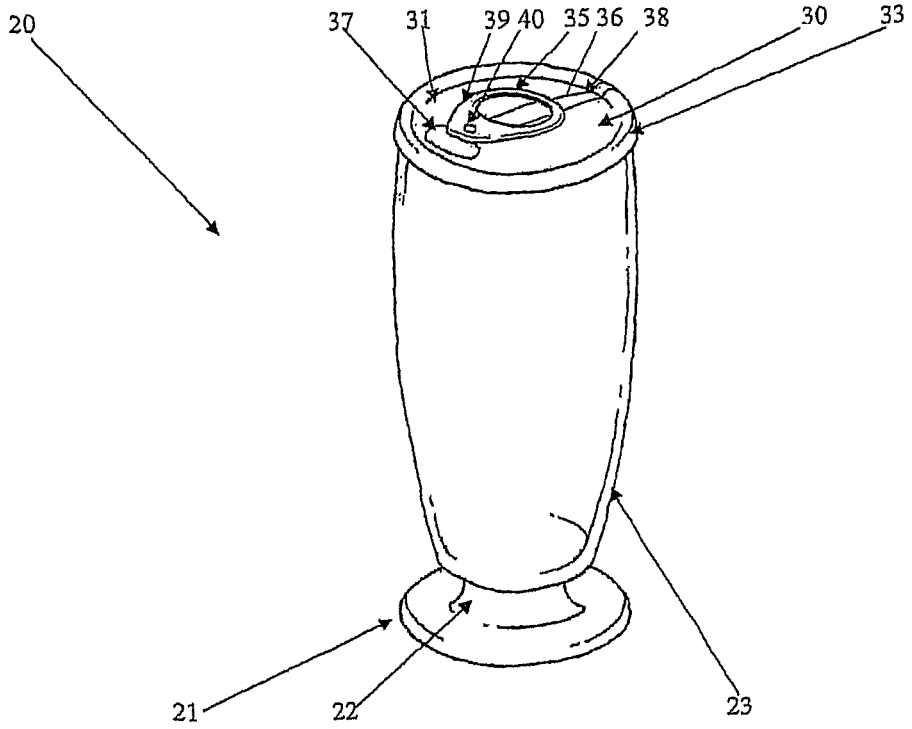
FIG. 1 is a perspective of a beer glass according to an embodiment of the present invention.
Figure 2:
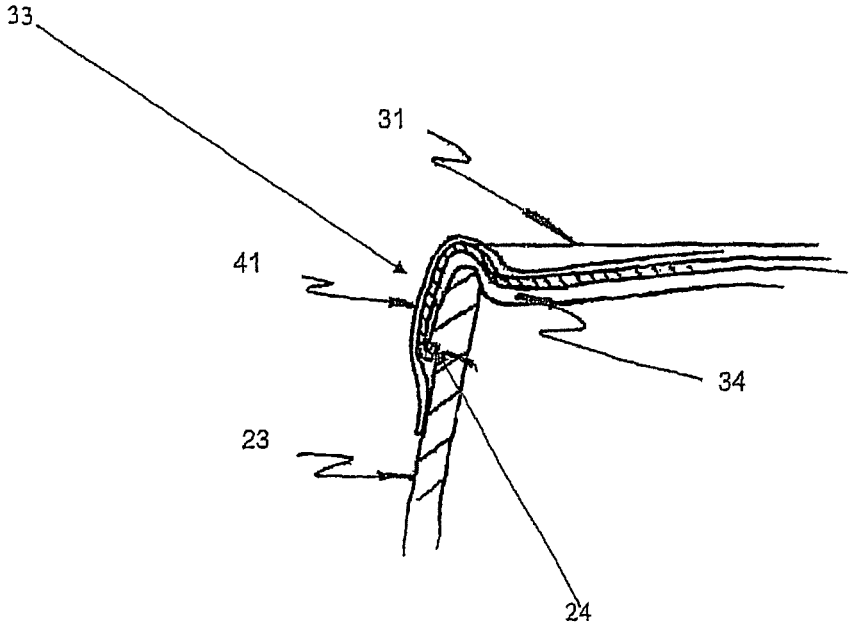
FIG. 2 is a cross-section of an upper portion of the beer glass illustrated in FIG. 1 taken along the line 2-2.

The various embodiment of the invention will now be described in detail. Initially, reference is made to FIGS. 1 and 2 which illustrate a sealed, pre-filled beer glass 20 according to an embodiment of the present invention.

The glass 20 includes a generally flat circular base 21, a stem 22 extending upwardly from the base 21, and an elongate, gently tapered cylindrical container portion 23 which extends upwardly from the stem 22.

The bottom of the container portion 23 is closed so that the beer which is stored in the container portion 23 cannot leak through the bottom.

The top of the container portion 23 has an opening (not visible) surrounded by a continuous lip 24 which protrudes from the tapered side walls of the container portion 23 by about 1 millimeter. The opening of the container portion 20 is covered by a lid 30 such that the beverage contained in the container portion 20 is sealed therein by the lid 30.

The lid 30 is adapted to be substantially removed from the opening so as to thereby enable the beer stored in the container portion 23 to be consumed from the glass 20 through the opening thereof.

The lid 30 includes a unitary piece of preformed aluminium having a substantially planar circular disc portion 31 whose underside is surrounded by a circular recessed portion 32 and a sleeve portion 33. A seal 34 provided by a thermoplastic elastomer is co-moulded to the underside of portions 31, 32, and 33 of the lid 30. The disc portion 31 includes a removable portion 35 which is defined by a frangible line 36 which extends along the disc portion 31. The removable portion 35 includes two sub-portions: a circular sub-portion 37; and an elongate sub-portion 38 extending from the circular sub-portion 37. An ergonomically-shaped pull-key 39 which is constructed from an engineering thermoplastic is fixed to the removable portion 35 at the junction of the circular and elongate sub-portions 37, 38 by aluminium rivet 40 such that the rivet 40 forms an airtight seal with the disc portion 31.

After the container portion 23 of the beer glass 20 has been filled with beer, lid 30 is fitted over the opening of the container portion 23 such that the rim of the container portion 23 is received by the recessed portion 32 of the lid 30 and such that the sleeve portion 33 of the lid 30 covers the lip 24. The seal 34 forms an airtight seal between the container portion 23 and the lid 30 so that the beer is hermetically sealed inside the container portion 23. The lid 30 is secured to the container portion 23 by a mechanical bond between the sleeve portion 33 and the lip 24.

The width of the sleeve portion 33 is preferably such that the sleeve portion 33 covers, or at least partially covers those parts of the container portion 23 which will normally be contacted by the mouth and lips of a person when consuming the beer directly from the glass 20. For example, the width of the sleeve portion 33 may be such that it covers a cylindrical portion of the container portion 23 which commences at the rim thereof, finishes at least 15 millimeters below the rim, and includes the lip 24. This reduces the possibility of the aforesaid parts of the container portion 23 being contaminated prior to the lid 30 being removed.

The lid 30 and the upper portions of the side walls of the container portion may be covered with a plastic shrink sleeve or fuji seal 41. The sleeve or seal 41 may include a removable strip (not shown) which is defined by frangible lines extending along the sleeve or seal 41 such that the removable strip can be torn from the rest of the sleeve or seal 41 to thereby enable the sleeve or seal 41 to then be readily removed from the glass 20. The sleeve or seal 41 would protect the rim of the glass 20 from contaminants and would also provide an area where branding could be applied or where some simple instructions for opening the glass 20 could be printed.

Figure 3:
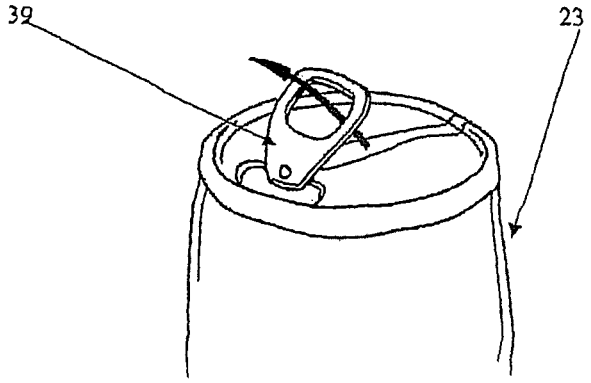
FIG. 3 illustrates an initial stage in the opening of the beer glass illustrated in FIG. 1.
Figure 4:
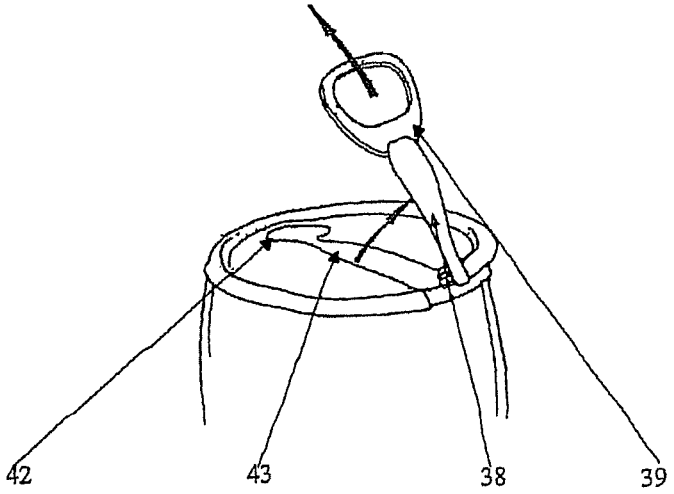
FIG. 4 illustrates a further stage in the opening of the beer glass illustrated in FIG. 1.

To open the beer glass 20, a person lifts the pull-key 39 upwardly in the direction of the arrow A shown in FIG. 3 using their fingers until the portion of the pull-key 39 which is closest to the circular sub-portion 37 contacts the circular sub-portion 37 and presses against that sub-portion to thereby detach the sub-portion 37 from the rest of the lid 30 except the elongate sub-portion 38. This initial stage of opening the glass 20 is similar to opening conventional aluminium cans and also results in a circular aperture being produced in the lid 30 through which the beer inside the glass 20 can be poured or consumed. A person may drink from the glass 20 at this stage or may proceed to completely remove the lid 30 before consuming the contents of the glass 20. To completely remove the lid 30, the person must at least substantially detach the sub-portion 38 of the removable portion 35 from the rest of the lid 30 by pulling the pull-key 39 in the direction indicated by the arrow B in FIG. 4 to thereby cause the sub-portion 38 to be lifted from the rest of the lid 30 in the direction indicated by the arrow C in FIG. 4. This causes the seal between the glass 20 and the lid 30 to be broken so that the lid 30 can then be removed from the glass 20. The circular aperture 42 and elongate aperture 43 formed in the disc portion 31 of the lid 30 are visible in FIG. 4.

Figure 5:
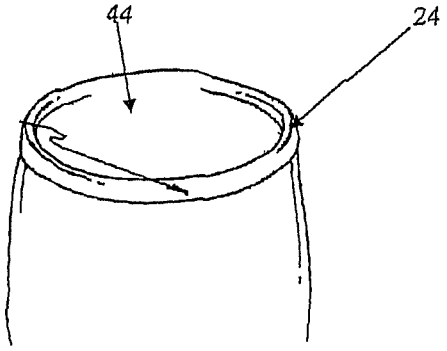
FIG. 5 depicts the upper portion of the beer glass illustrated in FIG. 1 with the lid removed.

FIG. 5 illustrates the top portion of the beer glass 20 after the lid 30 has been removed therefrom. The opening 44 and lip 24 of the container portion 23 are clearly visible in the figure.

Figure 6:
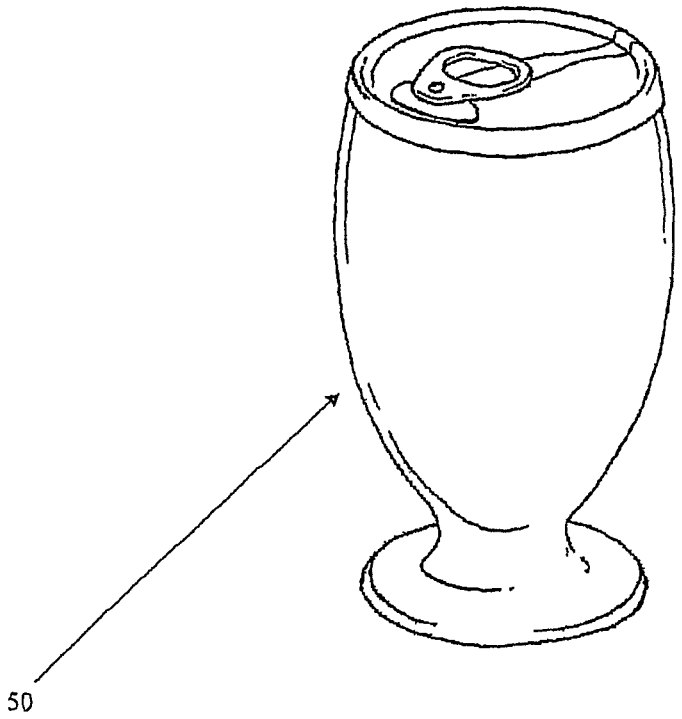
FIG. 6 is a perspective of a beer glass according to another embodiment of the present invention.
Figure 7:
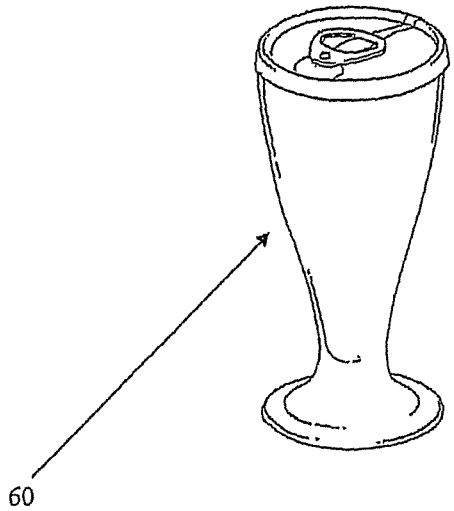
FIG. 7 is a perspective of a beer glass according to yet another embodiment of the present invention.

Various other glass embodiments according to the present invention are illustrated in FIGS. 6-7. The glasses 50 and 60 which are illustrated in FIGS. 6 and 7, respectively, each include a lid 30 which is similar to the lid 30 of the beer glass 20. The glasses 50 and 60 an be designed for pre-mixed drinks and wines respectively.

Each of the beer glasses 20, 50, and 60 is a pilsner drinking glass which is the type of drinking glass from which beer is often consumed.

Figure 8:
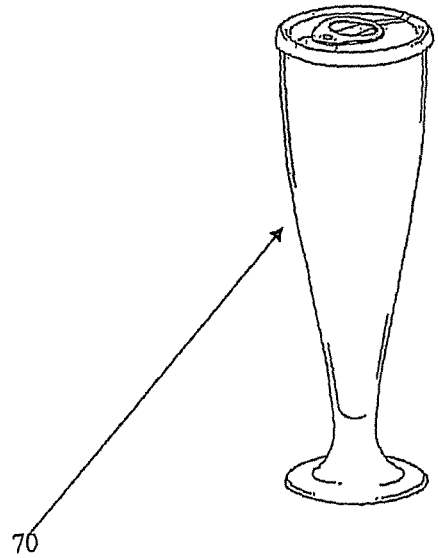
FIG. 8 is a perspective of a wine glass according to still yet another embodiment of the present invention

A sparkling wine glass 70 according to the present invention is illustrated in FIG. 8. The wine glass 70 is a flute-type drinking glass from which is the type of drinking glass from which sparkling or still white wine is often consumed. Similarly to the beer glasses 20, 50, and 60, the wine glass 70 includes a generally flat circular base 21, a stem 22 extending upwardly from the base 21, and an elongate, gently tapered cylindrical container portion 23 which extends upwardly from the stem 22. A lid 30 which is similar to the lids 30 of the beer glasses 20, 50, and 60 covers the glass 70 in the same manner as previously described in connection with the beer glasses.

Figure 9:
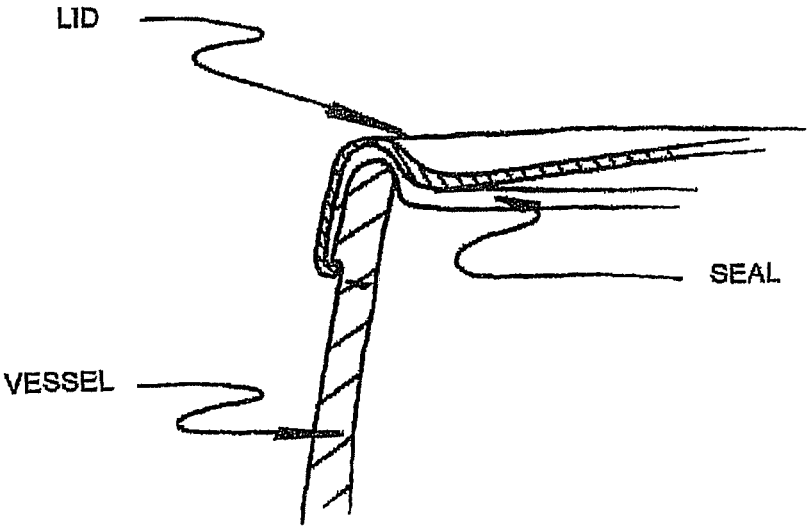
FIG. 9 is a cross-section of an upper portion of an alternative embodiment of a drinking beer glass according to the present invention which is similar to the cross-section illustrated in FIG. 2.
Figure 15:
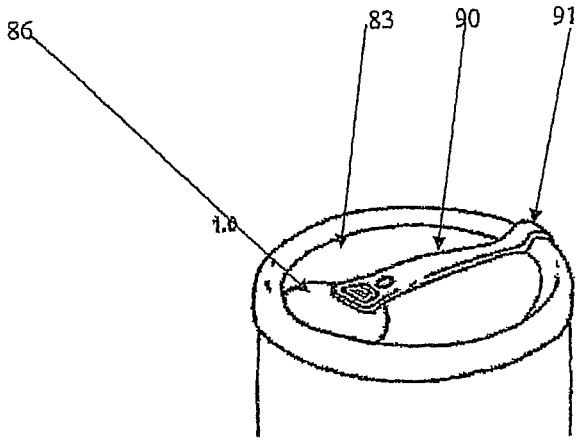
FIGS. 15-18 illustrate another embodiment of the invention illustrating a lever to open the lid and to enable removal of the lid from the drinking vessel. CONCEPT 2.
Figure 16:
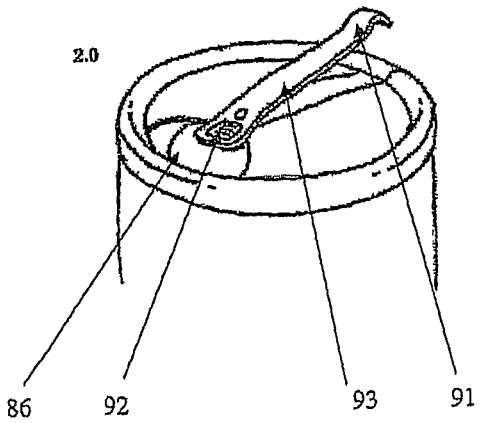
Figure 17:
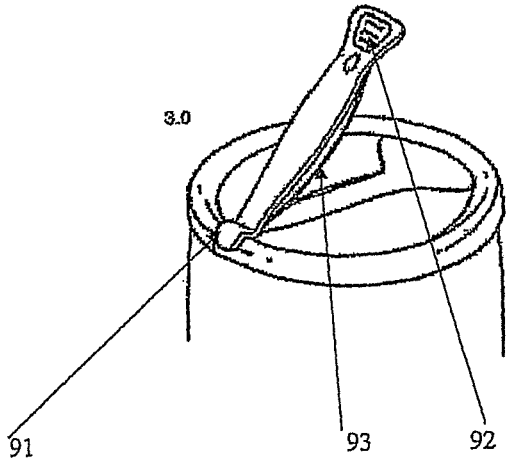
Figure 18:
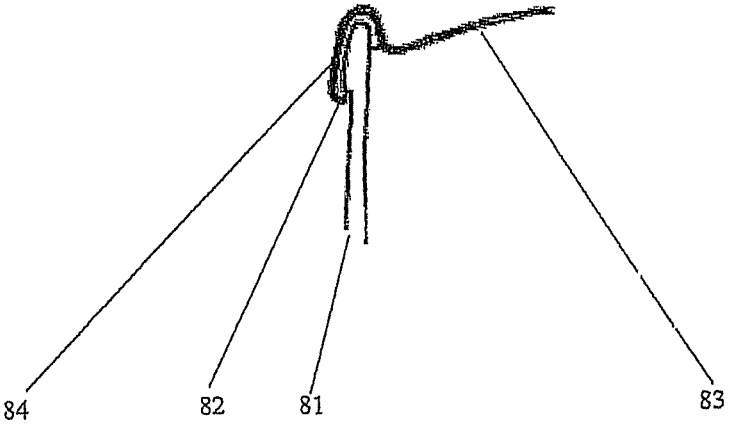
Figures 19, 20, 21, 22:
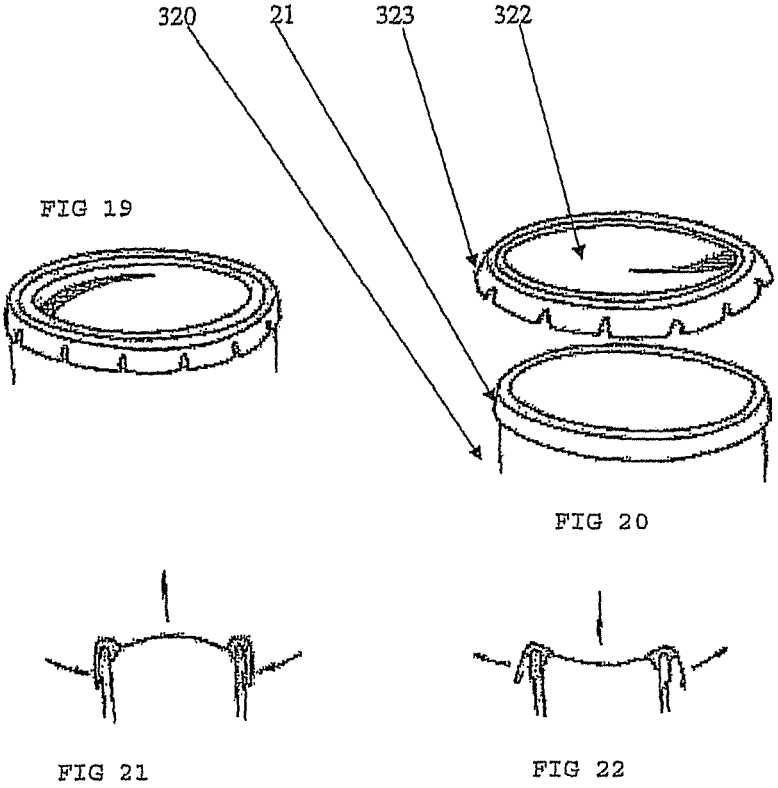
FIGS. 19-22 illustrate a further embodiment of the invention comprising a press top. CONCEPT 18.

FIG. 9 illustrates the lid 30 without the plastic shrink sleeve or fuji seal 41.

Referring now to FIGS. 10-14, there is illustrated CONCEPT 21 of the invention. In this version, the drinking vessel 450 contains the particular rim profile 451 (that is with the small horizontal land portion). The lid 452 is attached over the top of the drinking vessel 450 but can be removed by a pull tab 453. The pull tab 453 is initially parallel to the wall of the drinking glass (see FIG. 10) but can be lifted as illustrated in FIG. 11. The pull tab is attached to a circumferential band 453 which functions to attach the remainder of lid 452 to the drinking vessel. Once the pull tab is lifted, this causes band 453A to split in the area indicated by reference 454 and the pull tab can then be lifted away as illustrated in FIG. 13 which will loosen the lid and the lid can then be entirely removed as illustrated in FIG. 14.

FIGS. 15-18 illustrate CONCEPT 2 of the invention. The removal means comprises a lever 90 having an outer free end 91 that has pressed fitted over the rim 81. The free end of 91 can be lifted upwardly to cause part 86 of the lid to be pushed into the drinking glass. However, once lifted sufficiently to push part 86 inwardly, the other end 92 of the lever is then lifted to rip a removable strip 93 away from the remainder of the lid thereby enabling the lid to be more easily removed.

Referring now to FIGS. 19-22 (CONCEPT 18) there is illustrated a further embodiment of the invention. In this embodiment, the drinking vessel 320 contains a lip 321. A lid 322 is provided and which has a generally convex shape (see FIG. 21). The lid 322 contains a side wall 323 and when the convex shape is depressed to become concave (see FIG. 22), this causes the side wall 323 to expand, disengaging it from the lip and side wall of the drinking vessel to enable the lid 322 to be removed.

Referring now to FIGS. 23-26, there is illustrated CONCEPT 22 of the invention. In this version, drinking vessel 455 contains the lid 456 and lid 456 is provided with a pull tab 457. The pull tab 457 initially overlies the lid as illustrated in FIG. 23, but can be lifted up as illustrated in FIG. 24. The pull tab is lifted into this position such that leverage can be applied through the lever arm of the pull tab to split the lid along the tear lines provided 457A. This action disengages the lid 456 from the rim profile 451 (see FIG. 25) and allows the lid to be removed as illustrated in FIG. 26.

Figure 27:
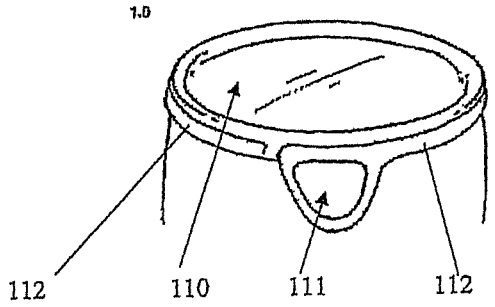
FIGS. 27-29 illustrate another embodiment of the invention which uses a tear away tab to remove the lid from the drinking vessel. CONCEPT 5.
Figure 28:
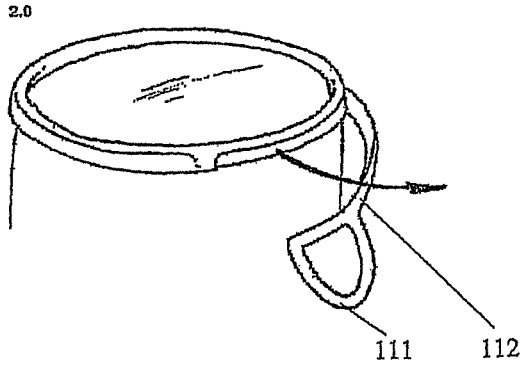
Figure 29:
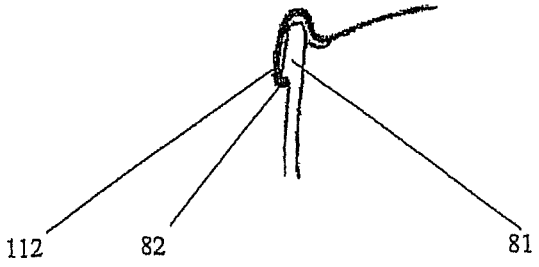

FIGS. 27-29 (CONCEPT 5) illustrate another embodiment to facilitate removal of the lid from the glass. Lid 110 is attached over the rim 81 of the glass. The lid 110 contains a pull tab 111 that is attached to a circumferential strip 112, strip 112 being attached to the remainder of the lid in a frangible or "breakaway" manner, typically by being separated from the remainder of the lid by a line of weakness or a multiplicity of small openings. To remove lid 110, pull tab 111 is grasped and pulled away from the lid in the manner illustrated in FIG. 28. Once the tab and the attached strip 112 have been entirely pulled away, this has the effect of removing the "mechanical attachment" of the lid to the rim thereby making the lid easy to remove.

Figures 30, 31, 32, 33:
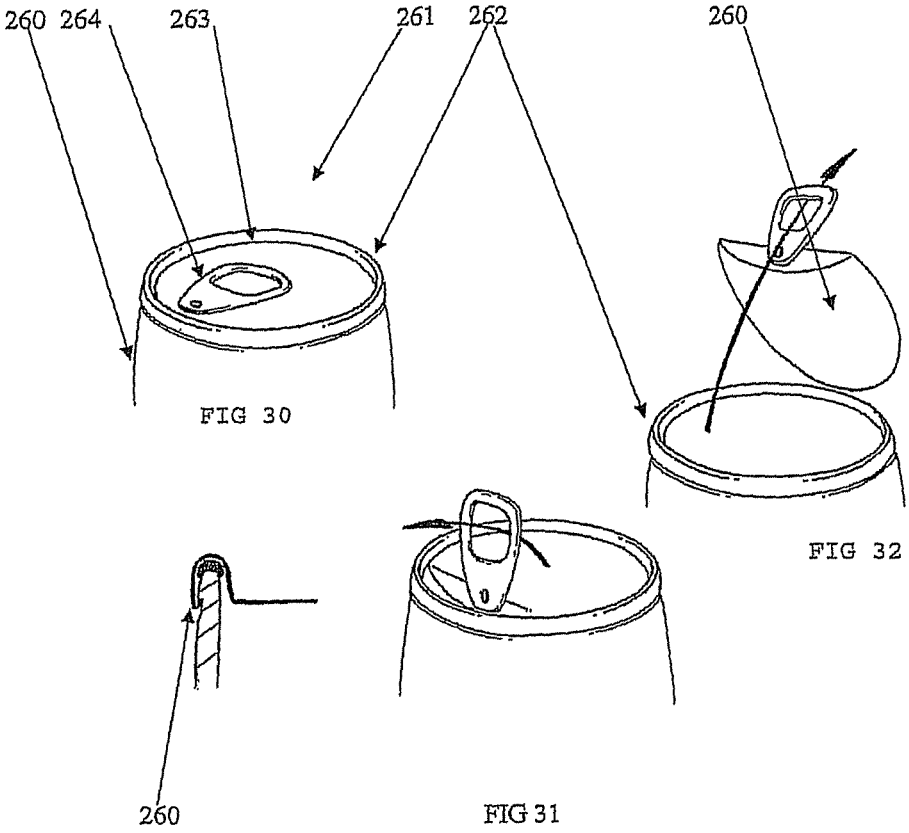
FIGS. 30-33 illustrate a further embodiment of the invention which comprises a "rip off" lid. CONCEPT 12.
Figures 34, 35, 36, 37:
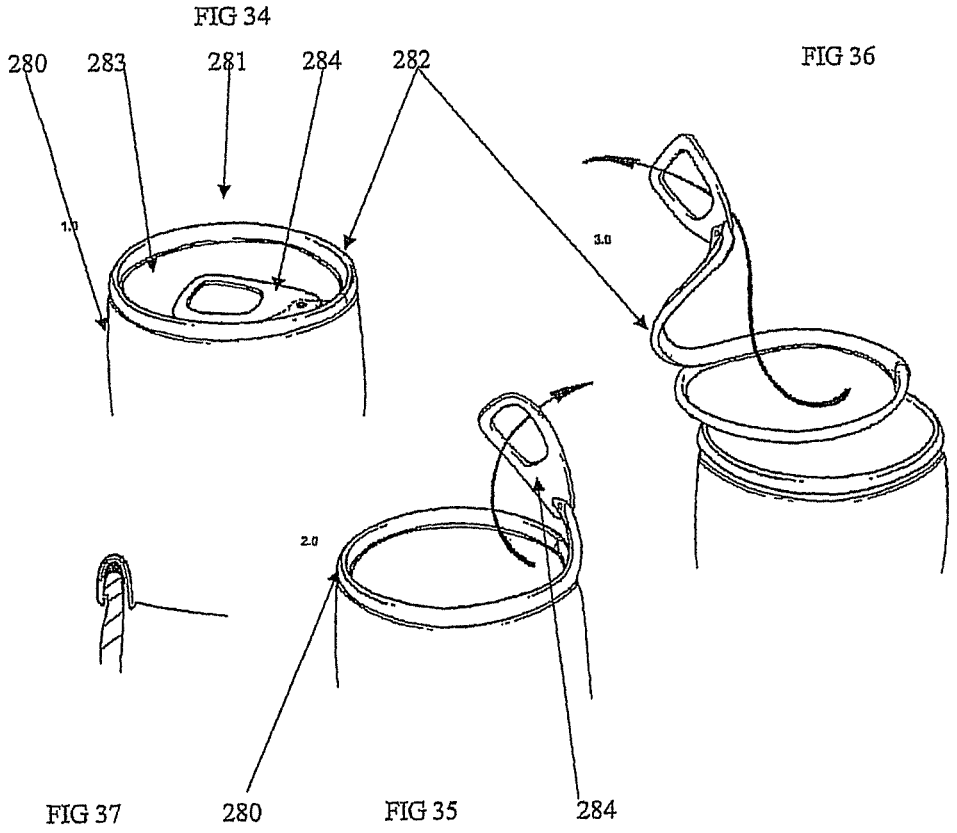
FIGS. 34-37 illustrate a further embodiment of the invention which comprises a "peel off" lid. CONCEPT 15.

FIGS. 30-33 illustrate a further concept (CONCEPT 12) of the invention. This concept can be seen as a "rip off" function. In this particular concept, the drinking vessel 260 is protected by a lid 261. The lid contains an outer ring 262 that extends over the rim of the drinking vessel 260. A centre portion 263 forms the remainder of lid 261, and the centre portion 263 contains a lifting tab 264. In practice, the lifting tab is lifted which will cause part of the centre portion 263 to be pushed downwardly and to rip away from the immediate adjacent portion of the outer ring 262 of the lid. This is best illustrated in FIG. 31 At this stage, the remainder of the centre portion 263 can be ripped away from the remainder of outer ring 262 this being best illustrated in FIG. 32. Thus, the outer ring 262 remains on the rim of the drinking vessel 260. The outer ring 262 can be made of relatively soft plastic or similar material to provide a pleasant drinking experience. The outer ring 262 can also prevent or reduce chips in the rim of the drinking vessel that can be caused by rough handling.

FIGS. 34-37 illustrate a further concept (CONCEPT 15) of the invention which can be seen as a "peel off" two part type lid. A drinking vessel 280 contains a lid 281 which consists of an outer ring 282 and a central section 283. In this concept, a lift tab 284 is provided, and the lift tab is attached to the outer ring 282. In practice, the lift tab is lifted which will cause the outer ring 282 to split (see FIG. 35). The outer ring can then be partially peeled off the rim of the drinking vessel 280 best illustrated in FIG. 35. Once a sufficient amount of the outer ring 282 has been removed, the central section 283 can be removed from the drinking vessel 282 to entirely remove the lid from the drinking vessel, this being best illustrated in FIG. 36.

Figure 38:
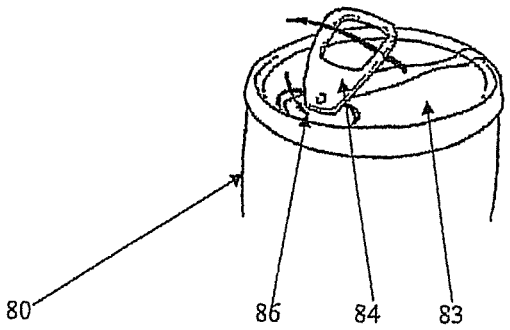
FIGS. 38-40 illustrate an embodiment of the invention which comprises a ring pull to remove the lid from the drinking vessel. CONCEPT 1.
Figure 39:
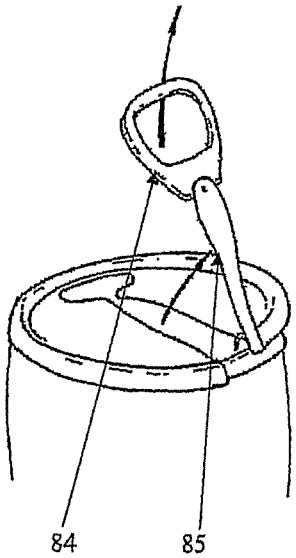
Figure 40:
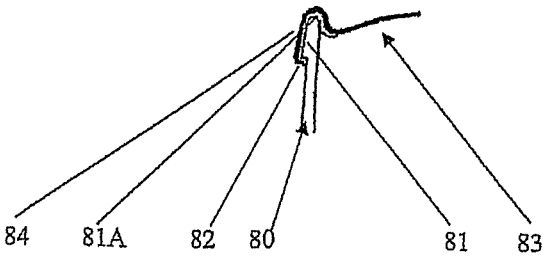

Referring to FIGS. 38-40, there is illustrated an embodiment of the invention (CONCEPT 1) which comprises a beverage vessel or glass containing a side wall 80. The side wall contains a top rim 81 (see FIG. 40). The rim extends upwardly from the side wall 80 and therefore defines a substantially outwardly extending and horizontal shoulder portion 82 that has a width of between 0.5-5 millimeters. Attached over the top of rim 81 is a lid 83. Lid 83 contains a peripheral edge 84 that extends over the top of rim 81 and terminates against the underneath of shoulder portion 82. Thus, the lid 83 is mechanically attached to the glass. This enables a better and stronger sealing and particularly enables the glass to contain a carbonated beverage if desired.

An annular seal 81A is positioned over the rim 81 and below lid 83. As the lid 83 can now be mechanically attached quite aggressively to the glass, this enables the seal 81A to be strongly compressed against the glass to enable the entire system to be quite pressure tight.

Removal of lid 83 is made easier than just trying to prise the peripheral edge away from rim 81, by providing a pull tab. The pull tab in this particular embodiment comprises a ring pull 84 which is attached to a strip member 85, the strip member 85 forming part of lid 83 and being defined by a zone of weakness to enable the strip to be pulled out of the remainder of the lid. The ring pull 84 is initially pulled forwardly (see FIG. 38), that pushes inwardly another part 86 of lid 83, which facilitates removal of the ring pull and the strip member 85. Once this has occurred, further pulling of the tab will lever the lid off the glass and against the mechanical attachments of the lid to the rim (and particularly to the shoulder portion 82).

Figure 41:
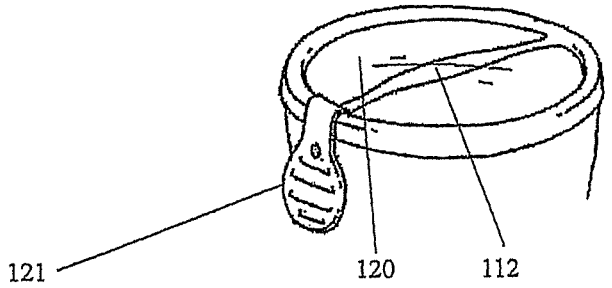
FIGS. 41-43 illustrate another embodiment of the invention which uses a tear away tab that is pulled upwardly to remove the lid from the drinking vessel. CONCEPT 6.
Figure 42:
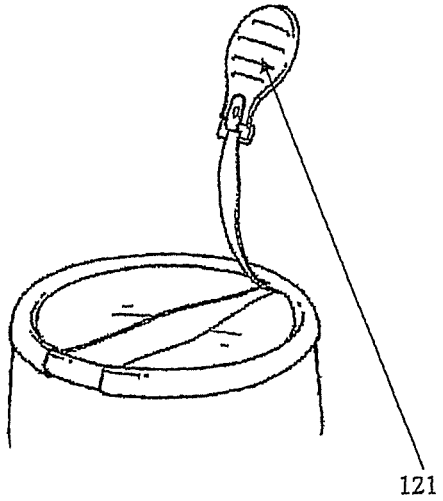
Figure 43:
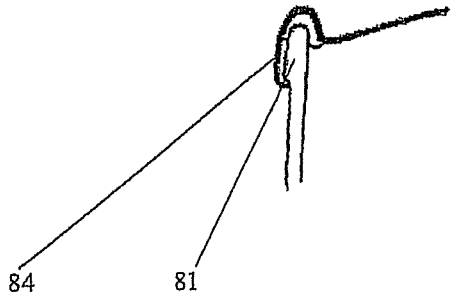
Figures 44, 45, 46, 47, 48:
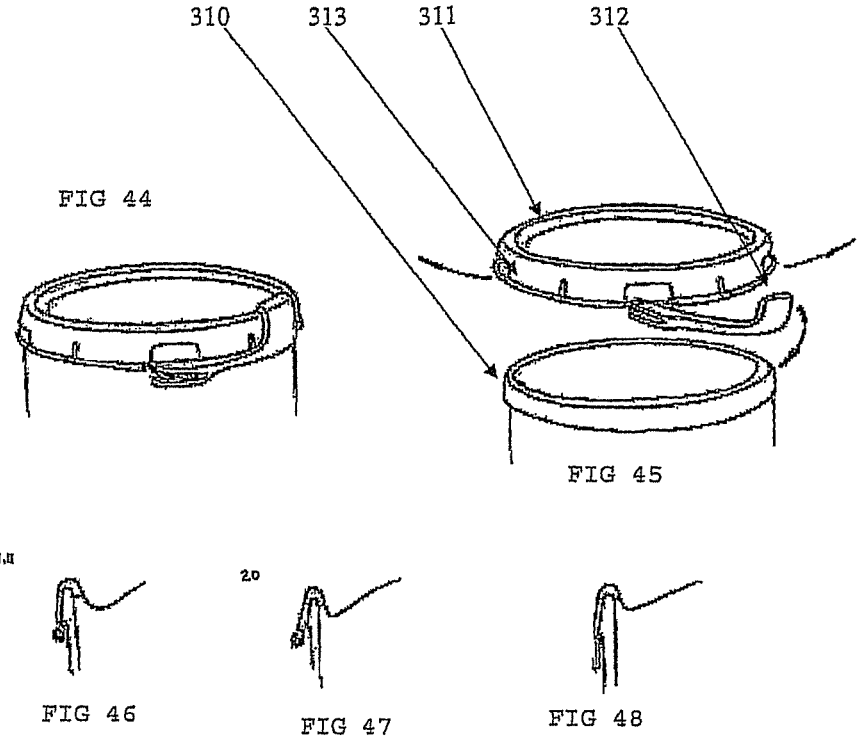
FIGS. 44-48 illustrate a further embodiment of the invention comprising an over centre locking mechanism. CONCEPT 17.
Figures 53, 54, 55, 56:
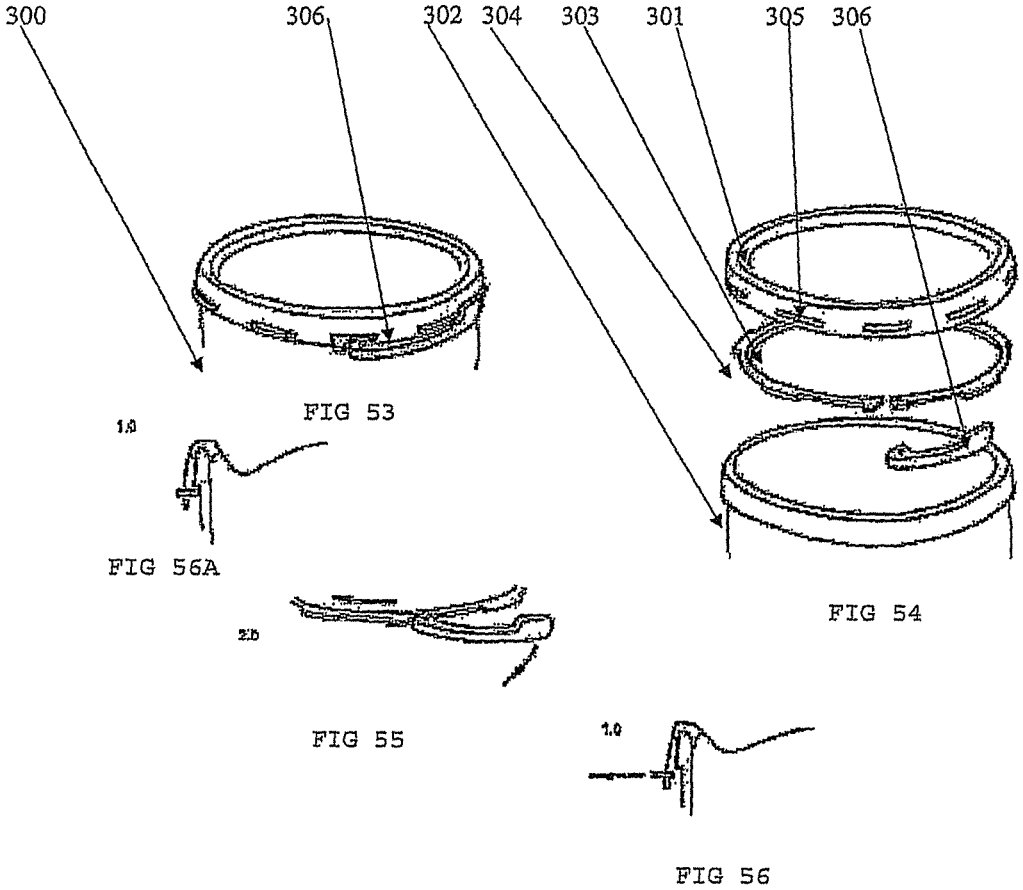
Figures 57, 58, 59, 60:
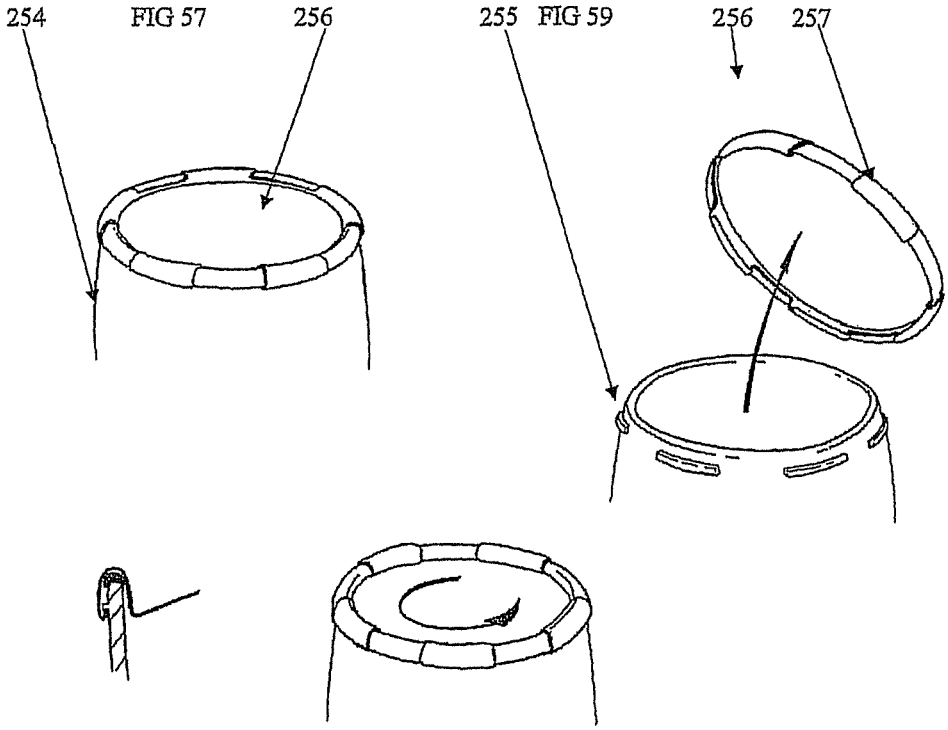
FIGS. 57-60 illustrate a further embodiment of the invention comprising a lid that can be twisted off the drinking vessel. CONCEPT 11.

FIGS. 41-43 (CONCEPT 6) illustrate another embodiment of the invention and particularly the means by which the lid can be removed from the glass more easily. In this embodiment, lid 120 contains a pull tab 121 that is attached to a frangible strip portion 122. The pull tab can be lifted upwardly and pulled to rip the strip portion 122 from the remainder of lid 120. This weakens the lid sufficiently to enable the lid to be removed quite easily by the pull tab 121.

Referring now to FIGS. 44-48 there is illustrated a further embodiment of the invention (CONCEPT 17). In this embodiment, there is provided a lip 310 and a clamping lid arrangement 311 that fits around lip 310 and again contains a lever 312 that can be pulled to spread a spring clip 313 to allow the clamping arrangement to be removed thereby allowing the lid 311 to be removed. The external spring clip may take a number of forms including the circular and flat cross-sections shown Referring now to FIGS. 49-52, there is illustrated CONCEPT 23 of the invention. In this version, the drinking vessel contains a lid 460 and the lid can be removed using a pull tab 461. The pull tab 461 is peeled up through a cutout section 462 (see FIG. 50) which leads into the tear line 463. As the pull tab is lifted further (see FIG. 52) the tear line 463 becomes exposed and pull tab 461 can peel off the outside portion 464 of lid 460 which is the portion attached to the drinking vessel (see FIG. 51).

Referring now to FIGS. 53-56A, there is illustrated a further embodiment of the invention (CONCEPT 16). In this embodiment, the drinking vessel 300 is provided with a cap assembly which basically comprises a lip 302, a lid 301 which is fastened about lip 302 and a circlip 303 which is positioned inside lid 301 and is positively retained relative to the lid by providing the circlip 303 with a number of projections 304 that pass through corresponding slots 305 in lid 301 to stop the circlip and lid from separating. A lever 306 is positioned on the outside of the drinking vessel 300. The lever can be pulled (see FIG. 55) and in doing so, the lever will expand or spread circlip 303 to allow the lid 301 to release and be removed from the drinking vessel.

FIGS. 57-60 illustrate a further concept of the invention (CONCEPT 11). In this concept, the protective lid has a "twist off" type function. Specifically, a drinking vessel 254 is provided with discontinuous thread segments 255 (best illustrated in FIG. 59). A lid 256 can be attached to the segments. The lid 256 contains portions 257 that engage with the segments 255, however part twisting of the lid can cause the lid to be released. Although the lid needs to be twisted off the drinking vessel 254, initially, the lid can be pushed locked to the drinking vessel which causes portions 257 to ride over and engage underneath and around segments 255.

Figure 61:
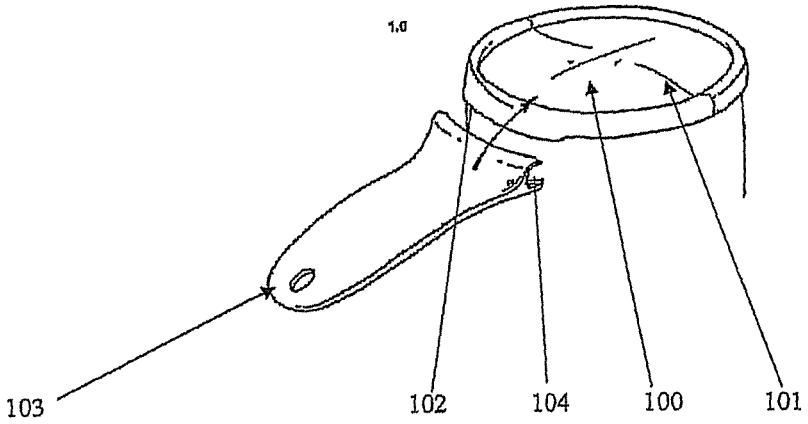
FIGS. 61-63 illustrate another embodiment of the invention which utilises a mechanical lever to pry the lid from the drinking vessel. CONCEPT 4.
Figure 62:
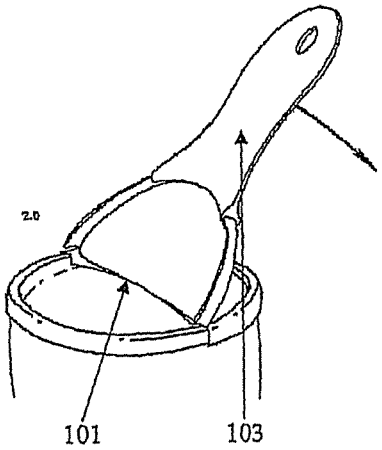
Figure 63:
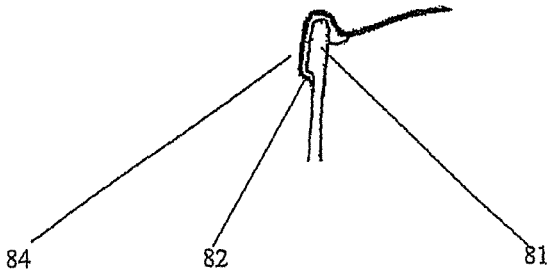

FIG. 61-63 illustrate another embodiment of the invention (CONCEPT 4) and particularly another embodiment of the lid design and the means by which the lid can be opened with little effort. Lid 100 contains a fold line 101 and is attached over the rim 81 of the glass in a manner similar to that described previously. However, the peripheral edge of the lid is provided with a small extending tab portion 102 (see FIG. 61) to provide a "purchase" for a separate lever 103 which contains an open mouth 104 designed to engage with the tab portion 102. Upon attachment of lever 103 to the tab portion 102, the lever is lifted upwardly (see FIG. 62) to bend lid 100 about fold line 101 to "half open" the lid. If desired, the lever 103 can then be removed and the beverage can be drunk with half the lid still in place. Alternatively, the lid can be pulled entirely off the glass if desired.

Referring now to FIGS. 64-67, there is illustrated CONCEPT 24 of the invention. In this version, the drinking vessel 470 has a lid 471. The lid is attached to the side wall of the drinking vessel by a retainer 472. The retainer 472 contains a small pull tab 473 that can be levered away to remove retainer 472 from the side wall 473A of lid 471. Once retainer 472 has been removed (see FIG. 65), the inner cap can disengage from the rim of the vessel and the lid can be quite easily pulled off the top of the drinking vessel. The pull tab 473 is attached to the retainer by a rivet.

Referring now to FIGS. 68-71, there is illustrated CONCEPT 25 of the invention. In this version, the lid 475 again contains a retaining ring 476. A pull tab 477 is attached to the retaining ring. The pull tab can be lifted (see FIG. 67) to remove the retaining ring from the side wall 478 of lid 475. Once this happens, the inner cap can disengage from the rim of the vessel and the lid can be quite easily removed.

Referring now to FIGS. 72-75, there is illustrated CONCEPT 26 of the invention. In this version, lid 480 is attached by a retaining ring 481. A pull tab 482 is attached to the retaining ring. Lifting the pull tab allows the retaining ring to expand allowing the side wall 483 of the lid to expand thereby enabling the lid to be removed.

Concepts 24-26 have the common feature of a removable strap, which compresses the inner rubber seal, and when the strap is broken/removed the seal can expand to disengage the sidewall of the lid/cap from the glass.

Figure 76:
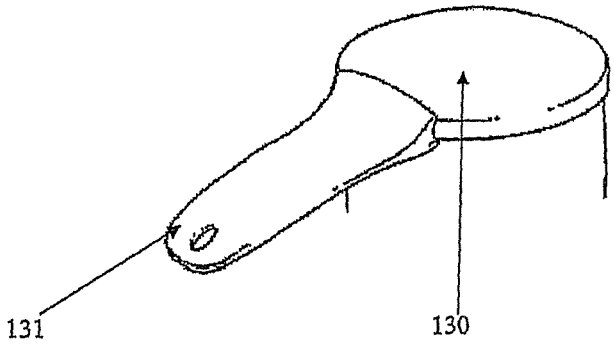
FIGS. 76-78 illustrate another embodiment using an opening lever. CONCEPT 9.
Figure 77:
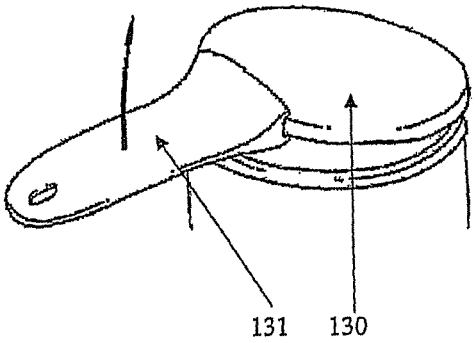
Figure 78:
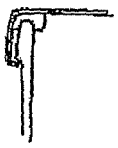
Figures 83, 84, 85, 86, 87, 88:
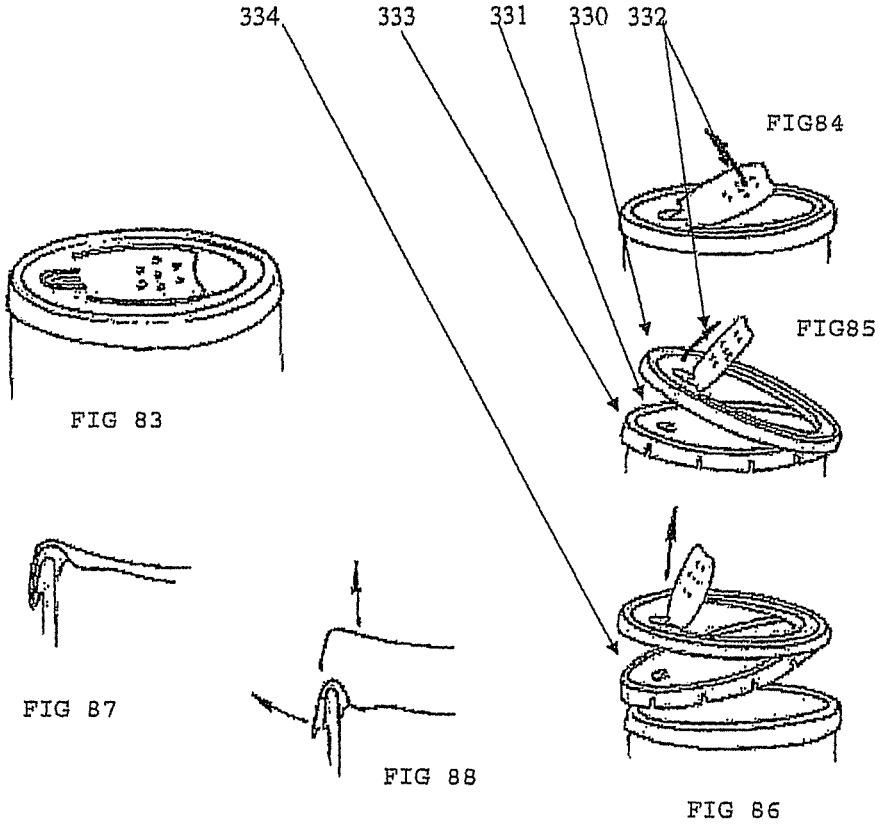
FIGS. 83-88 illustrate a further embodiment of the invention comprising a pull tab. CONCEPT 19.
Figures 89, 90, 91, 92, 93, 94:
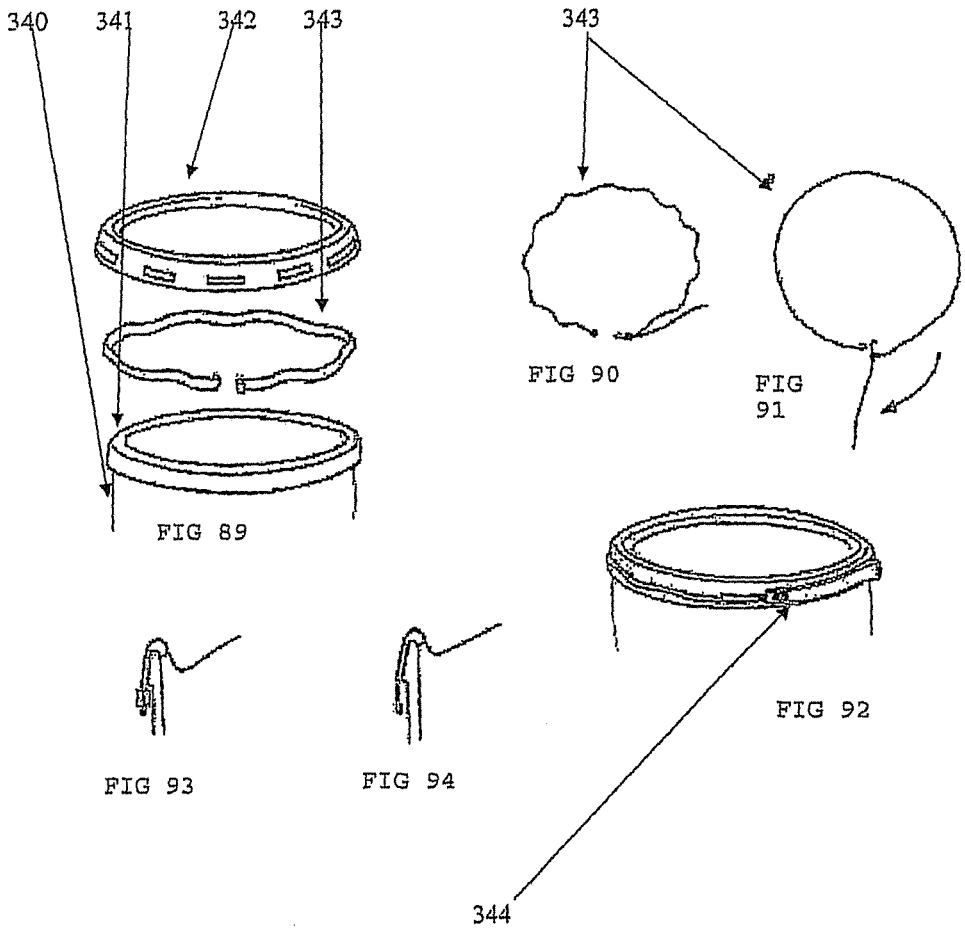
FIGS. 89-94 illustrate a further embodiment of the invention comprising a spring retainer. CONCEPT 20.

FIGS. 76-78 illustrate another embodiment of the invention (CONCEPT 9) to remove the lid 130 from a glass. In this embodiment, an opening lever 131 is provided that can grip the lid to pull the lid off the glass.

FIGS. 79-82 illustrate a further concept of the invention (CONCEPT 14) which can be seen as a "pop off" type lid. In this particular embodiment, the drinking vessel 270 contains a lid 271 which is made of two parts being an inner sealing member 272 which is best illustrated in FIG. 82 and which extends over the rim of the drinking vessel 270, and an outer part 273 which also extends over the rim of the drinking vessel and over the inner sealing member 272, and which is fixed to the drinking vessel 270. The outer part 273 has a perforated design which is best illustrated in FIG. 79 and the outer part 273 initially has a slightly convex shape which is best illustrated in FIG. 82. The design of the outer part is such that it is designed to be pushed downwardly against the inner sealing member 2, this being best illustrated in FIG. 80. When this happens, the outer part 273 becomes free from attachment to the drinking vessel 270. When this happens, the entire lid 271 can be removed, this being best illustrated in FIG. 81.

Referring out to FIGS. 83-88, there is illustrated a further embodiment of the invention (CONCEPT 19). In this arrangement, there is provided an outer lid 330 and an inner lid 331. The outer lid 330 contains a pull tab 332 and hinge system to allow pressure release as the tab is pulled upwardly. The inner lid 331 contains biased or pre-sprung segments 333 that are naturally biased outwardly to a "unlocking" position, but are held in place by the outer lid 330. Thus, when the outer lid 330 is removed (see FIG. 85), this will cause the segments 333 to "pop open" and be released from the lip 334. The top can then be removed from the drinking vessel.

Referring to FIGS. 89-94 there is illustrated a further embodiment of the invention (CONCEPT 20). In this arrangement, the drinking vessel 340 contains a lip 341 which is covered by a lid 342. A spring 343 is positioned around the lid 342 and has a number of curved sections, which pass through corresponding slots in the cap. These curved sections of spring 343 secure it to the lid 342 and continue through, securing the lid assembly to the lip 341. A lever 344 (see FIG.

92) is attached to spring 343 and pulling of the lever 344 causes to spring to expand and flatten to disengage the lid 342 from the lip 341 or drinking vessel 340.

FIGS. 95-98 illustrate various non-limiting embodiments of the design of the vessel and particularly of the shoulder portion to illustrate that no particular limitation should be placed on the invention merely by a particular type of shoulder portion.

Figure 95:
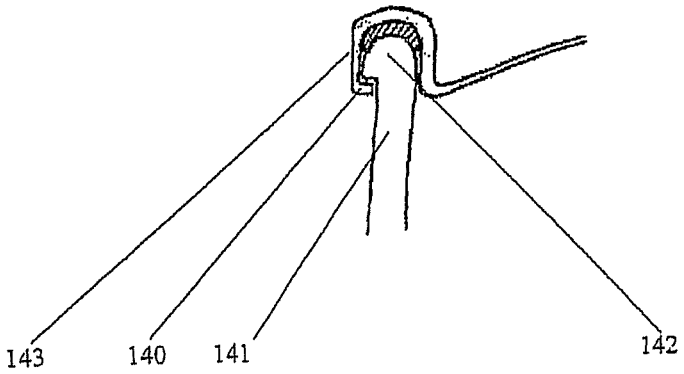
FIGS. 95-98 illustrate some variations of the rim design of the vessel and therefore variations on the shoulder portion.

FIG. 95 illustrates a shoulder portion 140 which comprises a horizontally extending and outwardly extending annular land portion that extends outwardly relative to the side wall 141 immediately below shoulder portion 140. Shoulder portion 140, in this particular embodiment is defined by a lower part of the outwardly extending rim 142 of the glass. The shoulder portion 140 provides a mechanical attachment of the peripheral edge 143 of the lid.

Figure 96:
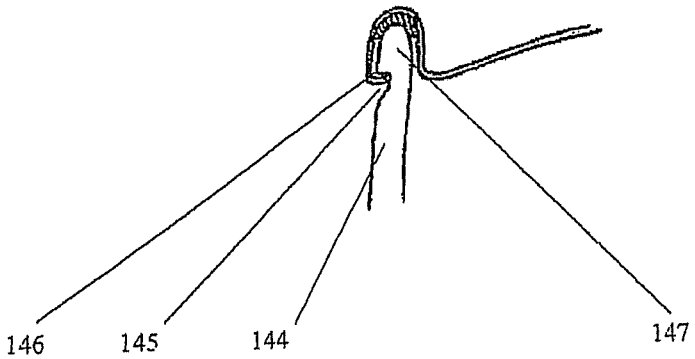

FIG. 96 illustrates an alternative embodiment where the side wall 144 of the drinking glass contains an annular recess 145 with the upper wall of the annular recess being substantially horizontal to define the shoulder portion 146. In this embodiment, rim 147 does not extend outwardly relative to side wall 144.

Figure 97:
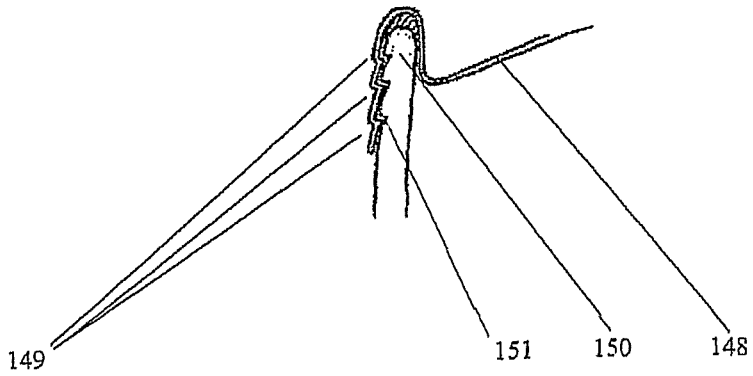

FIG. 97 illustrates an alternative embodiment that might be suitable should an extremely aggressive mechanical attachment be required between the lid 148 and the drinking vessel. In this embodiment, a plurality (three) of angular recesses 149 is provided extending below the upper edge of rim 150. Each recess 149 defines an upper shoulder portion 151. The peripheral edge of lid 148 can be mechanically attached relative to each shoulder portion such that in this particular embodiment, the peripheral edge of lid 148 is mechanically attached in three places to the drinking vessel.

Figure 98:
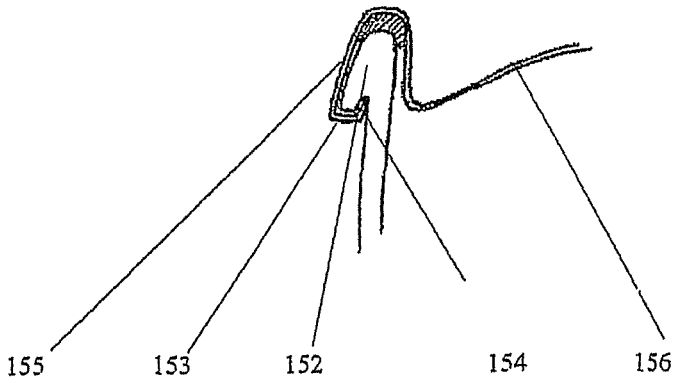
Figure 99A:
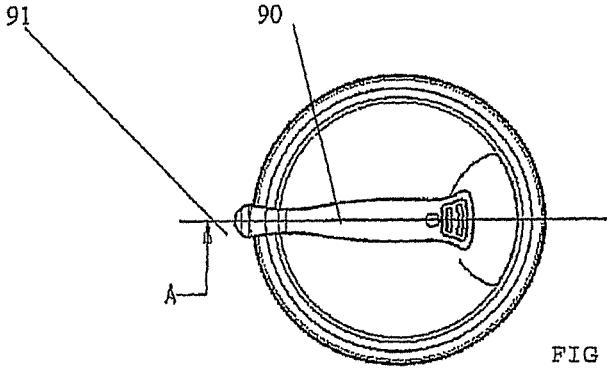
FIGS. 99, 99A, 100 and 100A, illustrate different views of a particular type of attachment of the lid to a drinking vessel.
Figure 99:
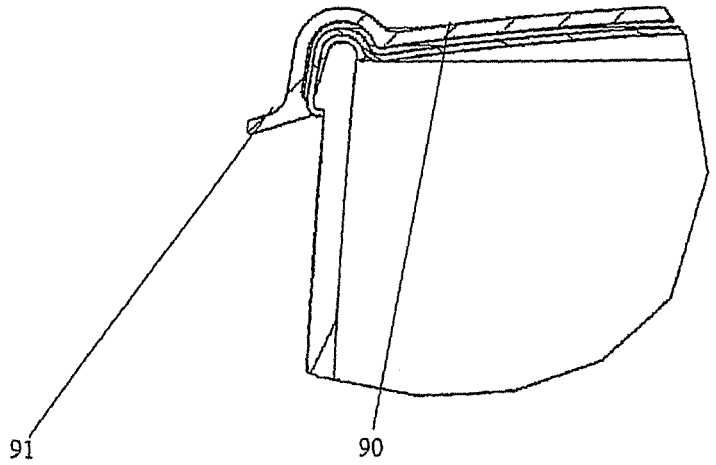
Figure 100A:
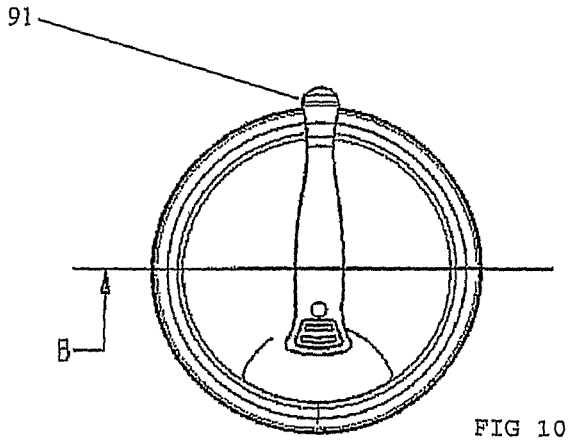
Figure 100:
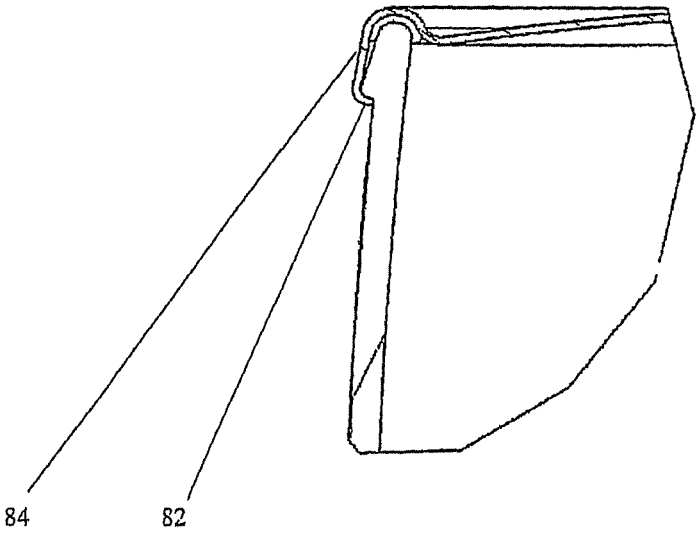
Figure 101:
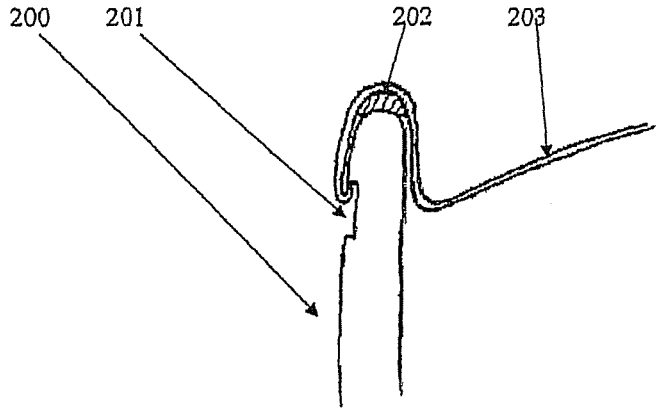
FIGS. 101-104 illustrates a further embodiment of the invention containing a substantially U-shaped channel formed in the outer wall of the beverage container to enable a lid to be snapped fitted to the container.
Figure 102:
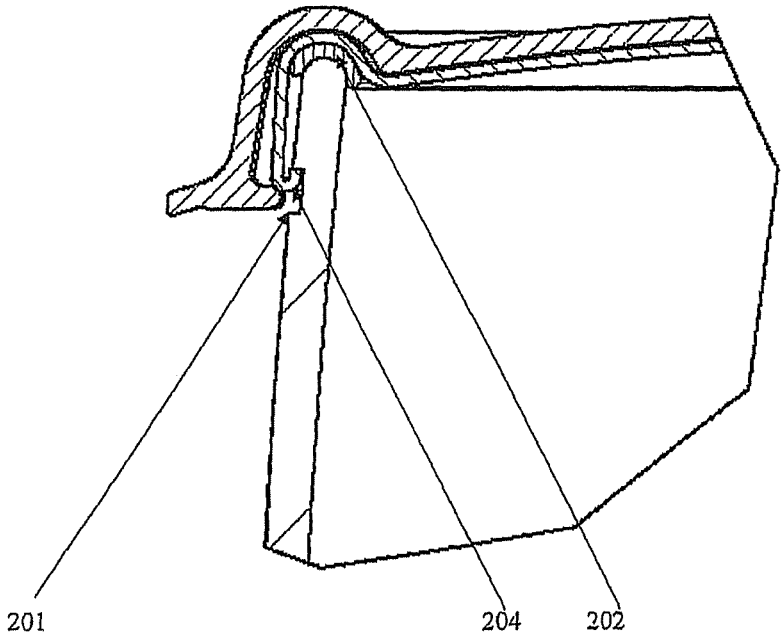
Figure 103:
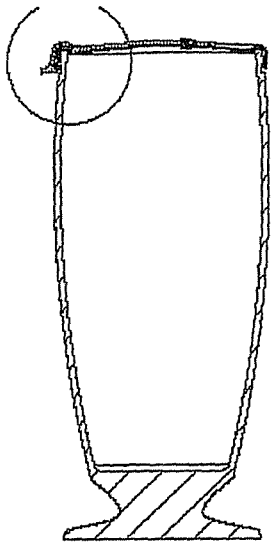
Figure 104:
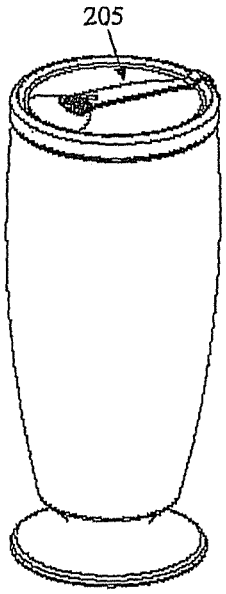

FIG. 98 illustrates a rim 152 containing a lower outwardly extending horizontal shoulder portion 153 containing an "undercut" 154. The peripheral edge 155 of lid 156 can be attached quite aggressively to the drinking vessel by enabling the peripheral edge to be positioned in the undercut 154 as well as about the shoulder portion 153.

FIGS. 99, 99A, 100 and 100A illustrate a plan view and a section view of a vessel and a lid which has been previously illustrated in FIGS. 15-18.

FIGS. 101-104 illustrates a further embodiment of the invention. In this embodiment, the beverage container 200 contains an annular U-shaped channel portion 201 in the outer wall of the beverage container and in the rim portion. A sealing bead 202 is provided which extends over the upper most part of the rim. A lid 203 contains an edge profile that enables the lid to be snapped over the rim of the container 200. Specifically, the edge profile contains a return lip 204 (see particularly FIG. 102) that fits into the U-shaped channel portion 201. The lid is "sprung" such that when the lid is pushed onto the rim of the beverage container, the return lip 204 is biased into the channel 201. This arrangement has the benefits of added strength and its non-return feature benefits the manufacturing process by simply snapping over the bead on the drinking vessel instead of having to be fixed via a mechanical post process.

A lift tab 205 can be provided in this embodiment, the lift tab being not dissimilar to that described previously.

Figure 105:
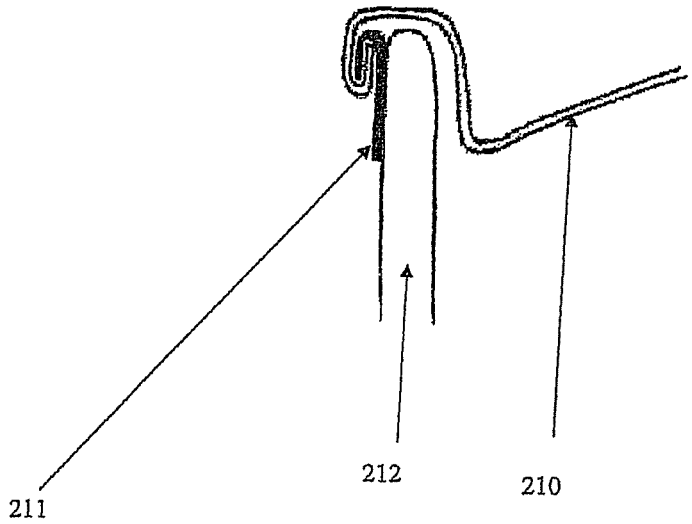
FIGS. 105-106 illustrate further variations of the possible attachment of a lid to a beverage container.
Figure 106:
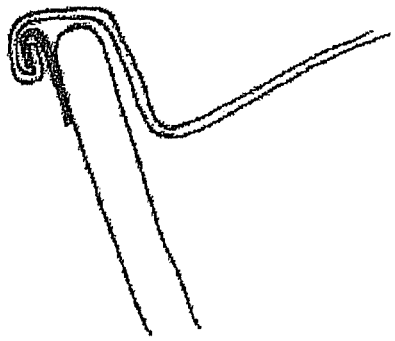

FIGS. 105-106 illustrate a different type of attachment. In this variation, the lid 210 is attached to an annular retaining section 211. The annular retaining section 211 is bonded to the drinking vessel 212 and provides the "purchase" to enable the lid 210 to be fitted to the drinking vessel. The variation in FIG. 106 relies on the mechanical strength of the taper to form the bond between the vessel and the cap retainer. This differs from the variation in FIG. 105, which relies on an adhesive bond.

Figure 107:
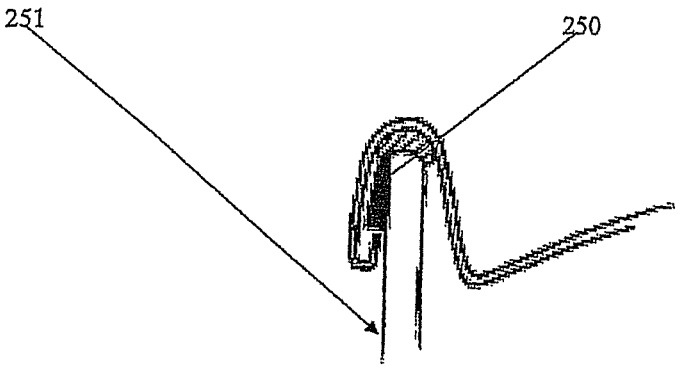
FIGS. 107-108 illustrate further bead variations.
Figure 108:
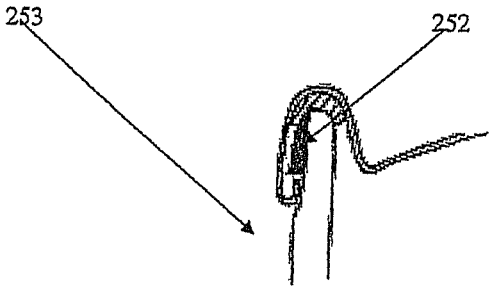

Referring to FIGS. 107-108 these show further bead variations. FIG. 107 illustrates a manufactured ring 250 which is bonded to a vessel 251 having a standard type rim. FIG. 108 illustrates a manufactured ring 252 which is bonded to a vessel 253 having a recessed rim.

Figure 110A:
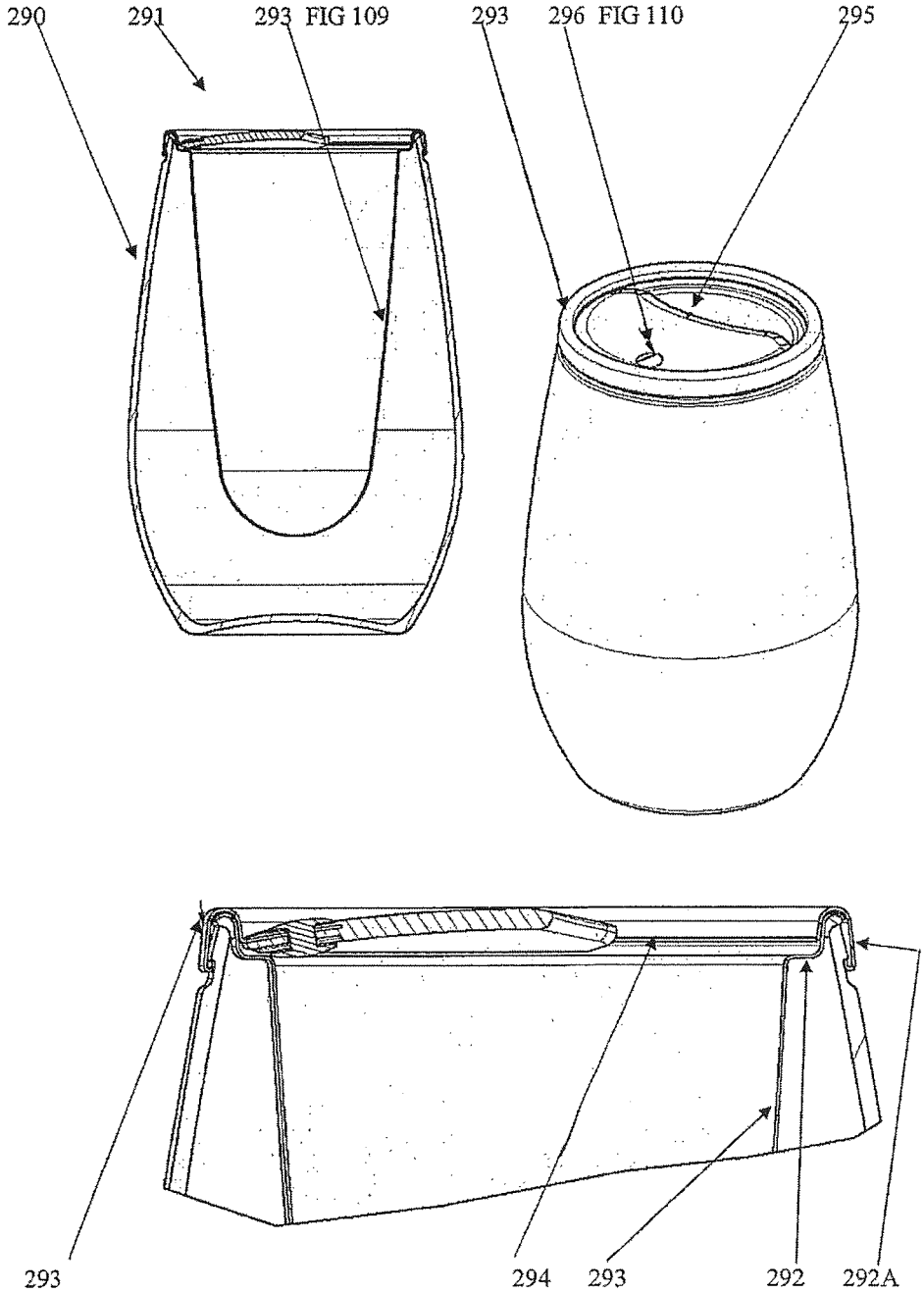

FIGS. 109-110A illustrate a further concept of the invention. This particular concept would find suitability for wines and other air sensitive beverages. The drinking vessel 290 contains a lid 291. The lid is again made of two main parts being an inner sealing part 292 that sits on the rim of the glass and contains the displacement bulb 293. this is secured in place by an outer locking part 292A that holds 292 in place by extending over it and keying into the recess in the glass wall. The inner sealing part 292 contains a large displacement bulb 293 which is best illustrated in FIG. 109 and which extends into the interior of the drinking vessel 290. The function of this bulb 293 is to displace the wine in the glass towards the top (rim) of the glass. The advantage of this is that the amount of air in the glass is minimal and therefore the wine will not deteriorate by contact with large amounts of air.

When the lid is removed, and the displacement bulb is removed from the inside of the drinking vessel, the wine level will be returned to some distance below the rim of the glass to present a glass of wine where the glass is not filled to the brim which is unacceptable. Thus, the bulb, in use, causes a temporary raising of the level of wine in the glass to minimise the trapped volume of air, and when removed, the wine level goes back to an "acceptable" level for the purposes of consumption.

The lid contains a tear tab 295 and a rivet 296 such that lifting of the tab 295 enables the lid to be removed.

In another form, the invention resides in a drinking vessel containing a removable lid, the drinking vessel being provided with a thread, the removable lid being provided with a complimentary thread such that the lid can be releasably attached to the drinking vessel via the thread. This can include the CONCEPT 7 form of the invention. In this form of the invention, there is an advantage in providing a thread of particular design so as to reduce the possibility of the thread becoming damaged and presenting a sharp edge. Therefore, in a more particular form of the above invention, the vessel may be provided with an external thread, the thread comprising a plurality of separate thread portions. In this more particular form of the invention, the thread portions can be made thicker and more robust. Suitably, the thread portions extend about the drinking vessel. The number of thread portions may be between 2-20, with a preferred number being between 5-15 although this number can vary depending on the size of the vessel. Each thread portion may have a length of between 5-30 millimeters although this can again vary depending on the size and diameter of the vessel. The lid will typically contain an internal thread to engage with the external thread on the drinking vessel. The lid will typically comprise a main body, and a depending side wall or flange and the internal thread will typically be positioned on the depending side wall or flange.

In another more particular form of the above invention, the vessel may be provided with an internal thread and the lid may be provided with an external thread. This can include the CONCEPT 10 form of the invention. Suitably, the lid sits substantially within the top of the vessel when attached. An advantage of this more particular form of the invention is that the drinking vessel (e.g. cup or glass) does not contain an external thread that may disrupt the drinking process. The thread may again comprise a plurality of thread portions that may be similar to that described above. Alternatively, the internal thread may comprise a continuous thread as the risk of damage to the internal thread is lessened.

The lid in this form of the invention may comprise a main body portion and a peripheral side wall or flange that may be provided with an external thread which may comprise a continuous thread or thread portions as described above.

In another form, the invention comprises a lid for a drinking vessel, the lid comprising a main body portion adapted to extend over the open top of the drinking vessel, and a peripheral depending side wall, the side wall containing a clamping means that is movable from a clamping position where the side wall is clamped to the drinking vessel, to an unclamping position where the lid can be removed from the drinking vessel. This can include the CONCEPT 3 form of the invention. An advantage of this form of the invention is that a lid can be attached quite tightly to a drinking vessel such as a glass which can be of ordinary design and which therefore does not require any special manufacture or design. However, it should be appreciated that the lid can be used on other types of drinking vessels that may be of special design; however a feature of this form of the invention is that the drinking vessel may be of conventional design. The clamping means may comprise a band member that extends at least partially and preferably entirely about the side wall of the lid. The band member can be constricted or expanded by the clamping means. In one form, the clamping means comprises a hinge type arrangement utilising an "over centre" type mechanism to create the clamping effect. Thus, the clamping means may comprise a first leg member attached to one part, or comprising one part of the band member, and a second leg member attached to another part or comprising another part of the band member, each leg member being hingedly attached relative to the band member, and some form of tab or like member that can be pulled by a person to open the clamping means thereby enabling the lid to be removed. In this form of the invention, the size and manufacture of the drinking vessel may be as described previously and the size and type of lid may also be as described previously. It is envisaged, in the second form of the invention, that a plurality of clamping means may be provided.

In another form of the invention, there is provided a drinking vessel containing a removable lid, the drinking vessel comprising a side wall containing an internal shoulder, an internal wall which seals the drinking vessel and which is at least partially connected to the drinking vessel by the internal shoulder, and pressure releasing means that is operable on the internal wall to move the internal wall from a first position where the internal wall and the vessel define a reduced internal volume, to a second position where the pressure releasing means enables the internal wall to move to a position where the internal wall and vessel define a larger internal volume, thereby reducing the pressure within the vessel, thereby facilitating removal of the internal wall. This can include the CONCEPT 8 version of the invention. In this form of the invention, the interior of the drinking vessel is kept under a higher pressure when the internal wall is in the first position which defines a smaller internal volume in the vessel (and therefore a higher pressure in the vessel). The pressure releasing means can then be activated or operated to enable the internal wall to move to the second position which defines a larger internal volume in the vessel (and therefore a lower pressure in the vessel). This enables the internal wall to be removed. The pressure releasing means may comprise a member or component that can push or maintain the internal wall into the first position. Thus, the pressure releasing means may comprise an elongate member that may extend over the top of the internal wall and be connected to the drinking vessel and which is movable between a locking position where the internal wall is in the first position, and an unlocking position where the internal wall can move to the second position. The elongate member can pivot, hinge, twist, flip or otherwise move between the locking and unlocking position.

The drinking glass according to the present invention is able to serve as both a container for storing beverages, and as a traditional drinking glass from which the contents thereof can be consumed directly therefrom in the usual manner. Preferably, the drinking glass is adapted to be reused.

The lid may comprise a rigid lid, a flexible lid, or a semi flexible lid. The lid may comprise a laminate of different materials to provide desired characteristics. The laminate may enable the lid to have the required properties of strength, gas impermeability, and the like. The lid may comprise a first zone or area comprising one material and a second zone or area comprising a second material. The lid may comprise one zone or area comprising a rigid material, and a second zone or area comprising a flexible material. The lid may be provided with a seal. The seal may be formed integrally with the lid, or may be formed separately and fitted to the lid, or may be formed separately and fitted to the container and the like. A seal is preferably provided inside the lid for forming a seal between the lid and the drinking glass. The seal may be made of any suitable material to provide a satisfactory sealing action. The seal may comprise a plastics material, a resilient material, a rubber, a neoprene, a sellable material, and the like. In a particular embodiment, the seal comprises a thermoplastic elastomer which is co-moulded to the inside of the lid.

Figure 111:
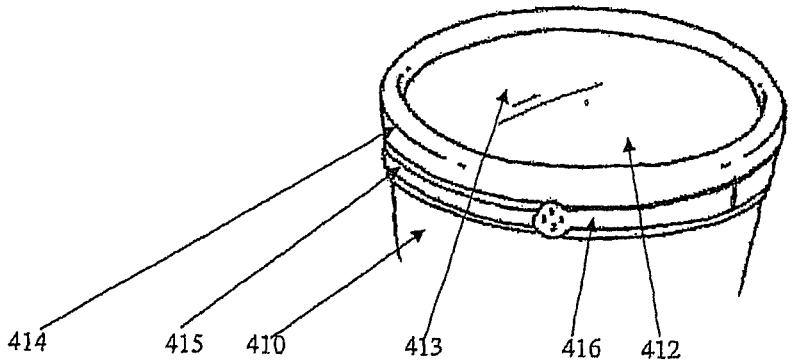
FIG. 111 illustrates a drinking vessel containing a lid that is clamped against the drinking vessel and which is in the clamping position. CONCEPT 3.
Figure 112:
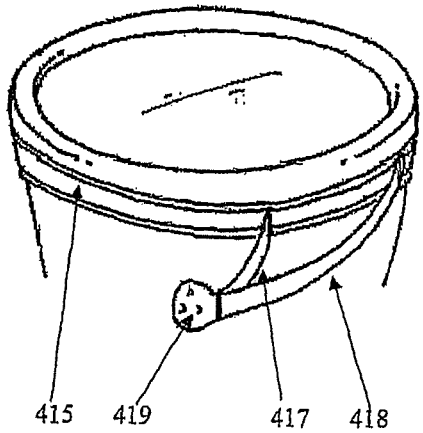
FIG. 112 illustrates the drinking vessel of FIG. 113, with the clamping means in the open position. CONCEPT 3.
Figure 113:
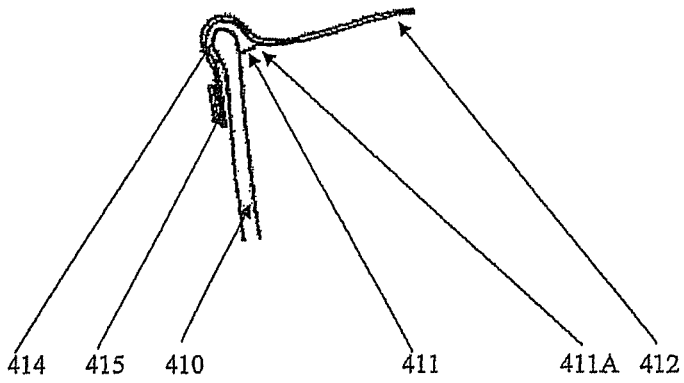
FIG. 113 illustrates a section view of the drinking vessel and lid of FIG. 113. CONCEPT 3.

Referring to FIGS. 111-113. and initially to FIG. 111, (CONCEPT 3) there is illustrated the upper part of a drinking vessel 410. The drinking vessel contains a peripheral rim 411 which is best illustrated in FIG. 113, and the peripheral rim can be of conventional design.

The drinking vessel is closed by a lid 412. Lid 142 contains a main body portion 413, and a depending side wall 414. The depending side wall 414 is designed to extend over rim 411 and somewhat down the side wall of the drinking vessel 410. Side wall 414 contains a band member 415 that extends about the drinking vessel 410. The band member 415 can be constricted (clamped) to hold lid 412 tightly to the drinking vessel 410, and released (unclamped) to enable lid 412 to be removed.

A sealing member 411A is fitted over the top of rim 411 and is clamped between rim 411 and lid 412 to provide a good pressure tight seal.

The clamping and unclamping is provided by a clamping means 416. Clamping means 416 uses an "over centre" type mechanism to release or to constrict the band member 415. The clamping means 416 contains a first leg member 417 and a second leg member 418 (see FIG. 112) which are attached to the band member 415 at spaced apart positions. A small tab 419 can be grasped by a person's finger and pulled away from the drinking vessel 410 into the position illustrated in FIG. 114, and this process will activate the clamping means into the released position to enable the lid 412 to be removed.

Referring to FIGS. 117-120 (CONCEPT 8), these figures illustrate a another form of the present invention. In this form of the invention, a drinking vessel 420 contains a peripheral rim 421 that is formed with an internal shoulder 422. An internal wall 423 is positioned inside the drinking vessel and is configured such that it is retained by engagement of the peripheral edge of internal wall 423 with the internal shoulder 422. The internal wall (best illustrated in FIG. 118) is slightly concave (when viewed in plan) or curved inwardly into the interior of the drinking vessel 420. In this "first position" of the internal wall 423, the concave configuration reduces the internal volume of the drinking vessel. Thus, if the drinking vessel is slightly pressurised, the pressure will force the internal wall 423 into sealing engagement against the internal shoulder 422.

The internal wall 423 is prevented from moving to a "second position" where the internal wall has adopted a convex configuration (when viewed in section), or curved outwardly from the drinking vessel. A pressure releasing means 424 holds the internal wall into the first position illustrated in FIG. 118. The pressure releasing means comprises an elongate member 425 having one end 426 attached to the rim 421 of the drinking vessel (see particularly FIGS. 118-120) and having another end formed with a tab 427 that can be lifted by a person.

Figure 119:
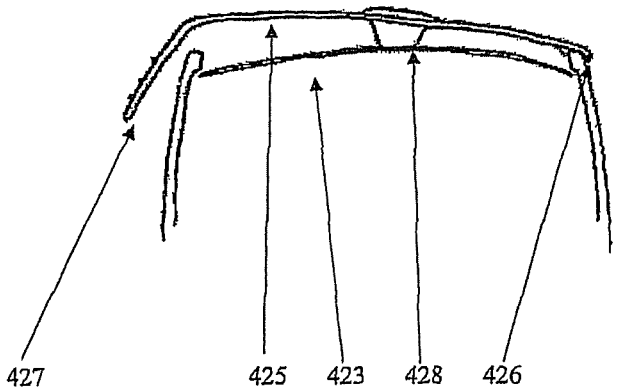
FIG. 119 illustrates the drinking vessel about to be opened. CONCEPT 8.
Figure 120:
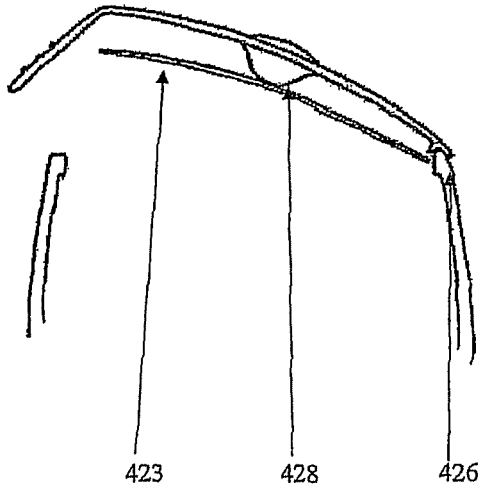
FIG. 120 illustrates the drinking vessel with the lid almost entirely removed from the vessel. CONCEPT 8.

The elongate member 425 can be clipped into the "locking" position illustrated in FIG. 119. However, lifting of tab 427 can cause the elongate member 425 to be lifted upwardly, this being illustrated in FIGS. 119-120. Upon lifting of the elongate member 425, the internal wall 423 can move from a concave position illustrated in FIG. 118, to the convex position illustrated in FIG. 119. In doing so, the pressure is reduced, and the internal wall 423 becomes freed from engagement against shoulder portion 422.

Further lifting of the elongate member (see FIG. 120) can cause the internal wall 423 to be entirely removed from the drinking vessel.

To stop the internal wall from falling into the drinking vessel, the wall is attached to a connecting piece 428

Figure 114:
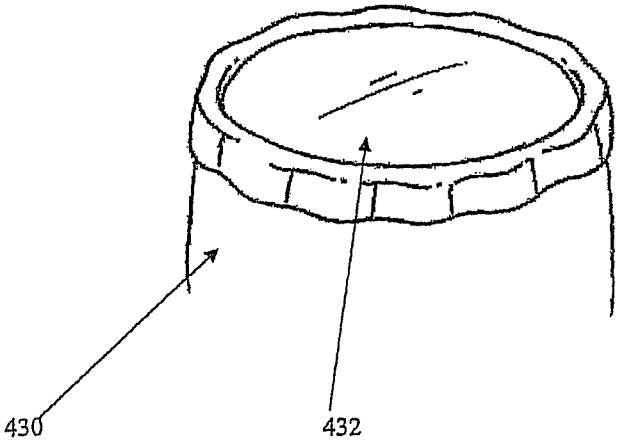
FIG. 114 illustrates a drinking vessel with a screw cap (lid) and in the attached position. CONCEPT 7.
Figure 115:
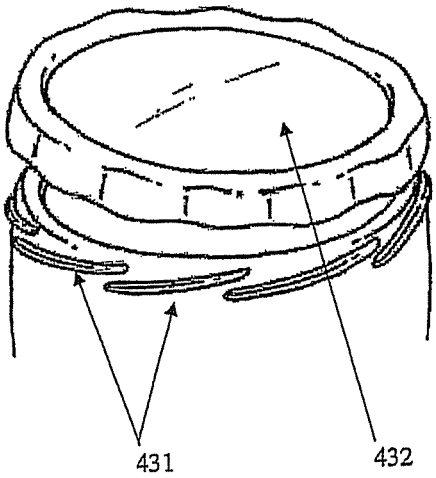
FIG. 115 illustrates the drinking vessel of FIG. 116 with the lid in the open position. CONCEPT 7.
Figure 116:
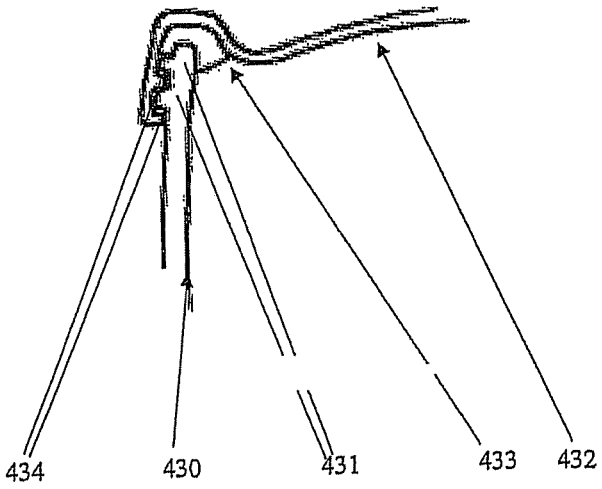
FIG. 116 illustrates a section view of the drinking vessel and the lid in the closed position and also illustrating the annular seal between the lid and the drinking vessel. CONCEPT 7.
Figure 117:
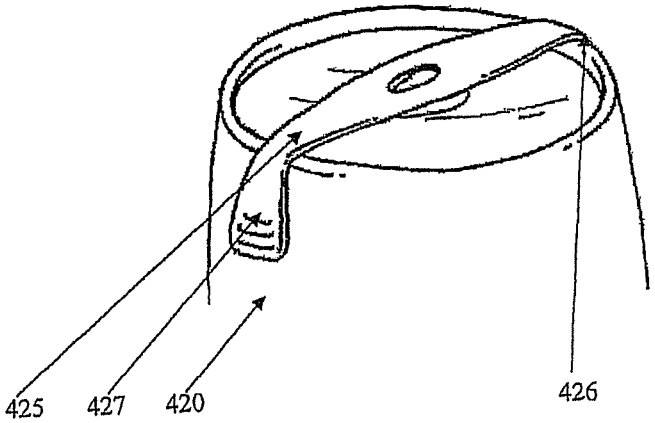
FIG. 117 illustrates a drinking vessel containing an internal wall and a pressure release means and in the closed position. CONCEPT 8.
Figure 118:
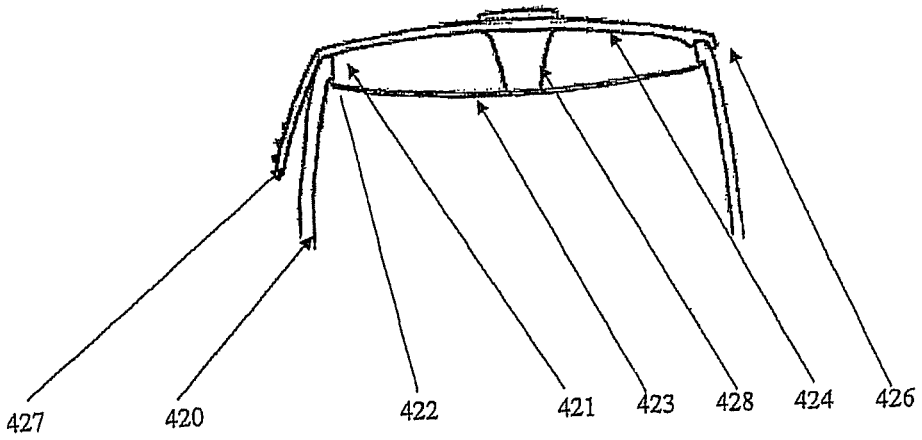
FIG. 118 illustrates the drinking vessel of FIG. 119 in section view and illustrating the internal wall in the closed position. CONCEPT 8.
Figure 121:
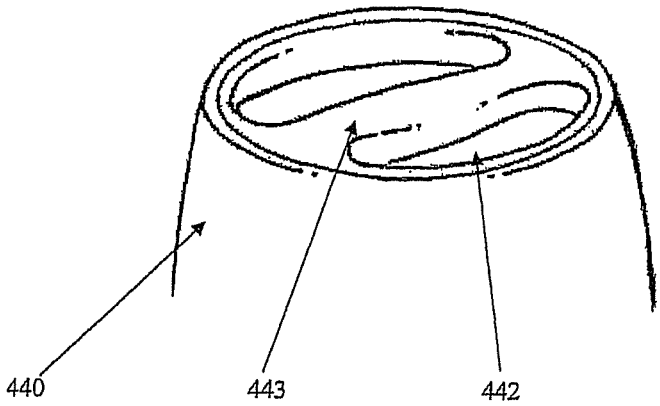
FIG. 121 illustrates a drinking vessel containing an internal thread and a lid containing an external thread and in the closed position. CONCEPT 10.
Figure 122:
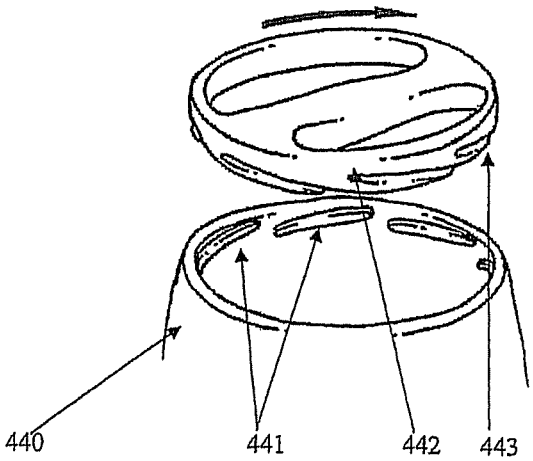
FIG. 122 illustrates the drinking vessel of FIG. 123 in the open position. CONCEPT 10.
Figure 123:
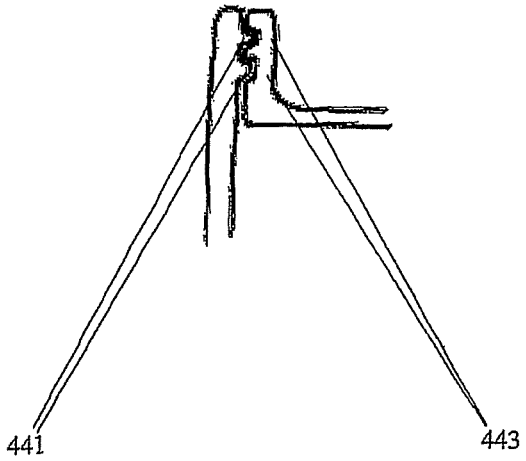
FIG. 123 illustrates a section view showing the internal threads on the drinking vessel and the external threads on the lid. CONCEPT 10.

Referring now to FIGS. 114-116 (CONCEPT 7), and FIGS. 121-123 (CONCEPT 10), these illustrate a first form of the invention where the lid is attached to the drinking vessel using a thread type arrangement. Basically, FIGS. 114-116 illustrate an external thread on the drinking vessel and an internal thread on the lid, while FIGS. 121-123 illustrate an internal thread on the drinking vessel and an external thread on the lid.

Referring initially to FIGS. 14-116, the drinking vessel 430 comprises a series of spaced apart thread portions 431 which are best illustrated in FIG. 115. These thread portions enable a lid 432 to be "twist locked" onto the drinking vessel in a pressure tight manner. An annular seal 433 (see FIG. 116) extends over the rim of the drinking vessel and is compressed between the lid 432 and the drinking vessel 430, and because of the design of the thread, the lid can be screwed quite tightly against the drinking vessel 430 thereby properly compressing the seal 433 to provide a good pressure tight fit.

The thread portions 431 are designed to enable the lid 432 to be unscrewed quite quickly without needing a full rotation of the lid to remove the lid from the drinking vessel.

FIG. 116 illustrates in section view the external thread portions 431 on the drinking vessel that mate with internal thread portions 434 on the lid, and particularly illustrates the seal 433 which is compressed between lid 432 and drinking vessel 430.

FIGS. 121-123 illustrate a different embodiment where the drinking vessel 440 comprises internal thread portions 441 (see FIG. 122) and the lid 442 contains external thread portions 443 (see FIG. 122). Lid 442 is designed to sit within the drinking vessel 440 and therefore contains a bridge 443 that can be manipulated by a person's fingers to enable the lid to be twisted into the open position.

The drinking vessel according to the present invention overcomes the difficulty of properly sealing a pressurised vessel (e.g. a glass containing sparkling wine) and where the glass has a relatively wide mouth (which makes the force on the seal rather large), by providing an aggressive but low profile extrusion around the perimeter of the glass. A cap/seal/lid can then be "keyed" into the profile to create a substantial bond between the two components. The cap can be made of an appropriate yet rigid material such as aluminium. The cap may have deformations in the profile to increase the strength and to allow conformity to the rim of the glass. A seal can be set between the rim and the cap, and the mechanical fixing of the cap will be such that a higher-level seal is formed to contain the contents of the glass.

Notwithstanding the aggressive attachment of the cap to the glass, the cap can still be removed quite easily by providing some form on the initial part that can be removed from the cap. The initial part may comprise a frangible portion in the cap, a pull tab, a tear off tab and the like. Once this is achieved, the user can easily overcome the remaining frictional forces between the glass/seal/cap and the cap can be removed quite easily.

The drinking glass according to the present invention is advantageous in comparison to other drinking glasses and containers in that it enables a beverage to be pre-packaged and branded in its own drinking glass so that consumers who prefer to drink their beverages from a drinking glass no longer have to transfer their beverage to a drinking glass but may instead consume the pre-packaged beverage directly from the drinking glass according to the present invention.

Also, in comparison to many prior art drink containers, the drinking glass according to the present invention, once emptied, has immediate intrinsic value as a reusable drinking glass which may be taken home. This has the consequence of reducing the amount of glass wasted. It also provides consumers with the choice of either keeping the glass or discarding it as part of a recycling program. The reusability of the drinking glass according to the present invention also has significant consequences in relation to the commercial marketability and perceived value of the item. These consequences will be discussed further on.

Another advantage of the drinking glass according to the present invention is that it virtually eliminates the problem in the hospitality industry of viral and bacterial illnesses being spread by the continual and frequent reuse of unsterile or improperly cleaned drinking glasses. The design of the lid completely protects the rim of the glass from contamination and accordingly, upon opening the glass, customers are guaranteed that the drinking surface of the glass is contaminant free. This hygiene aspect will likely have universal appeal and application across many product ranges including alcoholic, dairy, juice and soft drinks.

The drinking glass according to the present invention can be utilised in many markets. For example, the drinking glass may be utilised in the on-premises liquor market which includes consumption of liquor at bars, pubs, restaurants and clubs. The drinking glass may also find application in the off-premises liquor market which includes liquor purchased from bottle-shops and liquor barns for consumption at home. Moreover, the glass may find application in the fruit juice and soft drink market which includes all fruit juices, soft drinks, energy drinks, sport drinks and other non-alcoholic beverages. Also, the glass may find application in the dairy market which includes all liquid dairy products from plain milk to flavoured milk, iced coffee and other drinks.

For all of the markets mentioned in the preceding paragraph it is believed that the use of the drinking glass according to the present invention should strongly influence consumer's spending choices and present a significant point of difference from a marketing perspective to any other existing packaged product. This is not only a result of the packaging being novel, unique, hygienic, and environmentally friendly, but because the consumer is able to retain the packaging, which is effectively an aesthetically pleasing drinking glass, for continued re-use in the household. Thus, consumers will be faced with choosing between traditionally packaged products whose packages must be disposed of upon consumption of the product, or a drinking glass according to the present invention which has been specifically designed to be retained for future use at home as a drinking glass. It is believed that this will prove to be a considerable motivational purchasing factor for consumers.

The drinking glass according to the present invention also offers a significant branding opportunity for suppliers. Manufacturers could print their brand or trade mark directly on the glass (as opposed to applying a paper label). This would enable branding to be displayed on the glass even after it is washed many times in the hands of the consumer. The ongoing exposure of the brand on the glass in the hands of consumers would be of greater value to suppliers in comparison to other forms of packaging that are disposed of immediately after consumption of their contents.

A further advantage of the drinking glass is that it obviates need for those in the hospitality to chill drinking glasses in addition to the containers in which beverages are stored as the drinking glass according to the present invention serves as both a storage container and a drinking vessel.

Furthermore, by purchasing beverages that are stored in drinking glasses according to the present invention, vendors (including but not restricted to all beverage manufacturers) are able to reduce the amount of money which they outlay on purchasing drinking glasses.

Additionally, by purchasing beverages in the drinking glass, vendors in the hospitality industry are able to significantly reduce their expenses associated with cleaning used drinking glasses.

Furthermore, beverage companies can reduce the amount of money that they spend in their promotional budgets because the drinking glass serves as both a container and, with brands or trade marks printed thereon, a drinking glass which has promotional value.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

The invention claimed is:

1. A wide mouth beverage container containing a removable lid, the container comprising a base, an internal side wall extending generally upwardly from the base to a rim, an external side wall depending from the rim to a shoulder portion extending inwardly from the external side wall thereby forming an annular land portion, the removable lid comprising a main portion extending within the rim, and a sleeve portion that, when the lid is affixed to the container, extends over the rim and along the external side wall, wherein an edge of the sleeve portion includes a resiliently deformable return lip which is folded inwardly towards the side wall and upwardly towards the main portion of the lid from a lower tip of the side wall, such that the return lip extends upwardly towards the main portion of the lid at an acute angle to the sleeve portion, the return lip having a free end located laterally inside the sleeve portion and between the main portion of the removable lid and the lower tip of the sleeve portion, said upwardly extending lip of the return abutting against the annular land portion thereby attaching the lid to the container.

2. The container as claimed in claim 1, wherein the edge of the removable lid extends laterally over the rim and has a depending portion extending substantially parallel to the sidewall of the container, and the return lip is disposed at an acute angle relative to the depending portion.

3. The container as claimed in claim 1, wherein the edge of the removable lid extends laterally over the rim and has a depending portion extending substantially parallel to the sidewall of the container, and the return lip extends inwardly and upwardly from the depending portion such that the inwardly and upwardly extending portion of the return lip is at least partially disposed between the depending portion and the sidewall of the container.

4. the container as claimed in claim 1 comprising a base, the container having a width, and wherein the rim defines an upper opening having a whip substantially equal to the width of the container.

5. The container as claimed in claim 4 wherein the container has the shape of a drinking glass.

6. The container as claimed in claim 1, wherein the shoulder portion is defined by a circumferential groove in the sidewall of the beverage container.

7. The container as claimed in claim 1 wherein the container has a main outer body, and the sidewall comprises a thickened portion of the main outer body, and a shoulder portion extends between the thickened portion and the main outer body.

8. The container as claimed in claim 1, wherein the edge of the lid that extends over the sidewall of the container contains a pull tab or lift tab that can be manipulated to break at least part of the edge of the lid thereby enabling the lid to be removed.

9. The container as claimed in claim 1, wherein the lid contains a main portion extending within the rim of the container, the edge that extends over the rim and sidewall of the container, and a lift tab or a pull tab on the main portion that can be manipulated to break at least part of the main portion thereby enabling the lid to be removed.

10. The container as claimed in claim 1, wherein the removable lid is fabricated from metal, of a single skin construction.

11. The container as claimed in claim 1, were in the abutment between the return lip and the annular land portion of the shoulder portion is of sufficient mechanical strength to seal the container.

12. The container as claimed in claim 1, wherein the edge of the removable lid extends over the entire circumference of the rim.

13. The container as claimed in claim 1, wherein the removable lid forms a pressure tight seal with the container.

14. The container as claimed in claim 13 wherein the pressure tight seal with the container is sufficient to contain the internal pressures associated with the packaging of carbonated beverages.

15. A wide mouth beverage container containing a removable lid, the container comprising a base, a sidewall extending generally upwardly from the base to a rim, the sidewall having an internal surface and an external surface depending from the rim to a shoulder portion extending inwardly from the external surface thereby forming an annular land portion, the removable lid comprising a main portion extending within the rim, and a rigid sleeve portion that, when the lid is affixed to the container, extends over the rim and along the external surface of the container, wherein a lower edge of the rigid sleeve portion includes a resiliently deformable return lip which is located inwardly towards the sidewall and extending upwardly towards the main portion of the lid, the junction of the lower edge of the rigid sleeve of the lid and the return lip defining a pivot point therebetween about which the return lip pivots relative to the rigid sleeve during attachment of the lid to the annular land portion of the container, wherein, when the lid is being attached to the container, the resiliently deformable return lip transforms between a deformed condition in which the return lip abuts the sidewall of the container and is deformed towards an inner surface of the rigid sleeve portion, and an under formed condition in which the return lip returns to a naturally biased state in abutment with the annular land portion.

16. The container as claimed in claim 15 wherein the removable lid is fabricated from metal, of a single skin construction.

17. The container as claimed in claim 15, wherein the abutment between the return lip and the annular land portion of the shoulder portion is of sufficient mechanical strength to seal the container.

18. The container as claimed in claim 15, wherein the edge of the removable lid extends over the entire circumference of the rim.

19. The container as claimed in claim 15 wherein the removable lid forms a pressure tight seal with the container.

20. the container as claimed in claim 19 wherein the pressure tight seal with the container is sufficient to contain the internal pressures associated with the packaging of carbonated beverages.

* * * * *